US005724085A

United States Patent [19]

Inui et al.

[11] Patent Number: 5,724,085

[45] Date of Patent: Mar. 3, 1998

[54] COLOR THERMAL PRINTER AND COLOR THERMAL PRINTING METHOD

[75] Inventors: Fuyuki Inui; Tomoyoshi Nishimura, both of Saitama, Japan

[73] Assignee: Fuji Photo Film Co., Ltd., Kanagawa, Japan

[21] Appl. No.: 584,441

[22] Filed: Jan. 11, 1996

[30] Foreign Application Priority Data

Jan. 12, 1995 [JP] Japan ..... 7-003321
Nov. 14, 1995 [JP] Japan ..... 7-295802

[51] Int. Cl.[6] ..... B41J 2/325

[52] U.S. Cl. ..... 347/175; 347/218

[58] Field of Search ..... 347/173, 175, 347/218; 400/120.02, 120.03

[56] References Cited

U.S. PATENT DOCUMENTS 4,833,488 5/1989 Mizutani et al. ..... 347/175

*Primary Examiner*—Huan H. Tran
*Attorney, Agent, or Firm*—Birch, Stewart, Kolasch & Birch, LLP

[57] ABSTRACT

In a one-pass multi-head type thermal printer, a slack portion is provided in a recording sheet on each transport path from one thermal head to another. The slack portion is provided by a difference in transporting speed between adjacent two transport members, or by guiding the leading end of the recording sheet along a concavely curved guide member between the adjacent two thermal heads. A change in transporting speed caused by a change in load to the recording sheet during transportation is absorbed in the slack portion, and does not have bad influence on recording.

18 Claims, 14 Drawing Sheets

COLOR THERMAL PRINTER AND COLOR THERMAL PRINTING METHOD

BACKGROUND OF THE INVENTION

1. Field of the Invention

The present invention relates to a color thermal printer which has plural thermal heads and platen rollers arranged along a one-way path of a recording material, and a color thermal printing method for the color thermal printer. More particularly, the present invention relates to a color thermal printer and a color thermal printing method which are effective to avoid occurrence of stripes of irregularly higher or lower optical density which could be caused by changing load to the recording material being moved along the path.

2. Background Art

There are various color thermal printers, of which examples are direct thermal printing type and a thermal transfer printing type. Any of the types incorporates at least a thermal head in which a great number of heating elements are arranged in line. A thermosensitive recording sheet for use in the direct thermal printing type includes cyan, magenta and yellow recording layers. These recording layers have different thermal sensitivities and develop respective colors in different heat energy ranges from one another.

There is a one-pass multi-head type color thermal printer which has a plurality of, e.g. three thermal heads and in which a recording sheet is passed for one time under the thermal heads. The one-pass multi-head type has an advantage in that a shorter time is required for printing a full-color image compared with a three-pass one-head type color thermal printer which has one thermal head and in which a recording sheet is passed three times under the thermal head to record a full-color image.

FIG. 17 illustrates a direct color thermal printer of the one-pass three-head type. A color thermosensitive recording sheet 16 is transported along a substantially straight path by means of a plurality of pairs of feed rollers 3, 4, 5 and 6 whose axes are parallel to one another. Three platen rollers 10, 11 and 12 having parallel axes to the axes of the feed rollers 3 to 6 are disposed in series along the transport path, and a yellow recording thermal head 13, a magenta recording thermal head 14 and a cyan recording thermal head 15 are disposed across the transport path from the platen rollers 10, 11 and 12, respectively. The thermal heads 13 to 15 are movable between an upper retracted position and a lower actuating position by solenoids 7, 8 and 9. In the retracted position, the thermal heads 13 to 15 are set away from the recording sheet 16. In the actuating position, the thermal heads 13 to 15 get into contact with the recording sheet 16 and press it onto the platen rollers 10 to 12, respectively.

The recording sheet 16 is transported in the direction of an arrow shown rightmost in FIG. 17. When a print area comes to the yellow recording thermal head 13, the yellow recording head 13 is moved to the actuating position and starts recording a yellow frame of a full-color image to the yellow recording layer of the recording sheet 16. Then the yellow recording layer is fixed by an optical fixing device 17 for yellow. When the print area comes to the magenta recording head 14, the magenta recording head 14 comes to the actuating position and starts recording a magenta frame of the full-color image to the magenta recording layer. The magenta recording layer is fixed by an optical fixing device 18 for magenta. Likewise the cyan recording head 15 records a cyan frame of the full-color image to the cyan recording layer in the print area.

Accordingly, in the one-pass three-head type, if a full-color image has a length longer than the spacing between the heads 13 and 14 or when a plurality of full-color images are printed in continuous succession on the recording sheet 16, the magenta recording head 14 comes in contact with the recording sheet 16 while the yellow recording head 13 is recording the yellow image. As the thermal heads 13 to 15 are moved quickly to the actuating position, the recording sheet 16 abruptly receives the pressing force from the thermal heads 13 to 15, so that there occurs a rapid increase in load to the recording sheet 16 and the platen roller 11 each time any of the thermal heads 13 to 15 gets into contact with the recording sheet 16. In results, the recording sheet 16 is distorted to a certain extent.

Since the transporting speed of the recording sheet 16 is lowered temporarily according to the rapid increase in the load or the distortion of the transport system, a stripe SH1 of an irregularly higher optical density is provided in a portion of the recording sheet 16 where the yellow recording thermal head 13 is making print on the recording sheet 16 at the moment when the magenta recording thermal head 14 comes into contact with the recording sheet 16, as is shown in FIG. 18A. If a stepping motor is used for rotating the feed rollers 3 to 6, the rapid load change would cause the feed rollers 3 to 6 to stop in positions deviated from regularly determined stop positions, because the magnetic force and the load in transportation are balanced in unwanted fashion, even through the deviation are not so large as to cause the rotor of the stepping motor to fall out of step.

On the other hand, when the yellow frame recording is terminated, the yellow recording thermal head 13 is deactivated and is moved back to the retracted position. Then, the load of the yellow recording thermal head 13 to the recording sheet 16 abruptly decreases to zero. Since the abrupt decrease in the load also results in a temporary increase in the transporting speed of the recording sheet 16, a stripe SL1 of an irregularly lower optical density takes place in another portion of the recording sheet 16 where the magenta recording thermal head 14 is recording at that moment, as is shown in FIG. 18B. Similarly, a stripe of a conspicuously lower optical density takes place in a portion where the cyan recording thermal head 15 presses the recording sheet 16 at that moment. Occurrence of irregularly high or low density stripes is conspicuous when the recording sheet 16 is tensed in the transport path.

If, however, the recording sheet 16 is too loose in the transport path, the recording sheet 16 is apt to jam between the rollers.

Load applied to the recording sheet during the transportation also depends on friction between the recording sheet and the thermal heads. The friction depends on the temperature of the thermal heads as well as the pressure of the thermal head to the recording sheet, because the surface of the recording sheet is softened or melted by heat to reduce the friction.

Since the thermal head is adapted to start recording with a delay from the contact with the recording sheet, there is a stage when the cold thermal head is in contact with the recording sheet. Therefore, a load change occurs also at the moment when the thermal head starts heating for the first time after coming to the actuating position. That is, the load to the recording sheet in transportation is reduced and thus the transporting speed is temporarily raised at that moment when the recording sheet starts to be heated.

For instance, when the magenta recording head 14 is moved down to the actuating position and then turned on to start heating the recording sheet 16 while the yellow recording head 13 is making print, a stripe SL2 of an irregularly low density is formed following the high density stripe SH1 in the yellow image. On the contrary, when the yellow recording head 13 is turned off to terminate heating and then moved up to the retracted position while the magenta recording head 14 is making print, a stripe SH2 of an irregularly high density is formed prior to the low density stripe SL1.

Also, dot percentage or coloring density per unit area, e.g. per line or per frame, has effect on the temperature of the thermal head, and hence on the friction between the thermal head and the recording sheet. Accordingly, the transporting speed can fluctuate due to the difference in dot percentage between frames to be recorded by the thermal heads.

The problem of such irregularly high or low density stripes occurs in the thermal transfer printers. Even if the stripes are not conspicuous, the change or fluctuation in the transportation load has bad effect on the color registration.

OBJECT OF THE INVENTION

In view of the foregoing, a prime object of the present invention is to prevent irregularly high or low density stripes and color registration failure which may be caused by the fluctuation in load to the recording sheet during transportation.

The present invention also has an object to provide a thermal printer wherein the above preventive measure is achieved with simple construction.

SUMMARY OF THE INVENTION

To achieve the above objects in a one-pass multi-head type thermal printer, the present invention provides a slack portion in a recording sheet on each transport path between adjacent two thermal heads. Since the quantity or length of the slack portion changes according to change in transporting speed relative to each of the adjacent two thermal heads, a change in load to the recording sheet, which is caused by one of the two adjacent thermal heads, is not transmitted to the other thermal head. That is, the slack portion absorbs the temporary change in transporting speed which is caused by the change in load to the recording sheet. Accordingly, the change in load does not adversely affect the recording.

The slack portions may be provided by a difference in transporting speed between adjacent two transport members, or may be provided by guiding the leading end of the recording sheet along a concavely curved or sagged guide member between the thermal heads.

It is preferable to monitor the quantity of the slack and keep it in a predetermined range by slightly changing the transporting speed of one transport member disposed before the slack portion, relative to the transporting speed of the other transport member disposed behind the slack portion. The transport member may be a pair of feed rollers rotated by a motor, or may be a platen roller rotated by a motor. When the motor is a pulse motor, the fine control of the transporting speed is preferably performed by changing pulse rate of motor drive pulses.

BRIEF DESCRIPTION OF THE DRAWINGS

Other objects and advantages of the present invention will become apparent in the following detailed description of the preferred embodiments when read in connection with the accompanying drawings, which are given by way of illustration only and thus are not limitative of the present invention, wherein like reference numerals designates like or corresponding parts throughout the several views, and wherein.

DETAILED DESCRIPTION OF THE PREFERRED EMBODIMENTS

Figure 1:
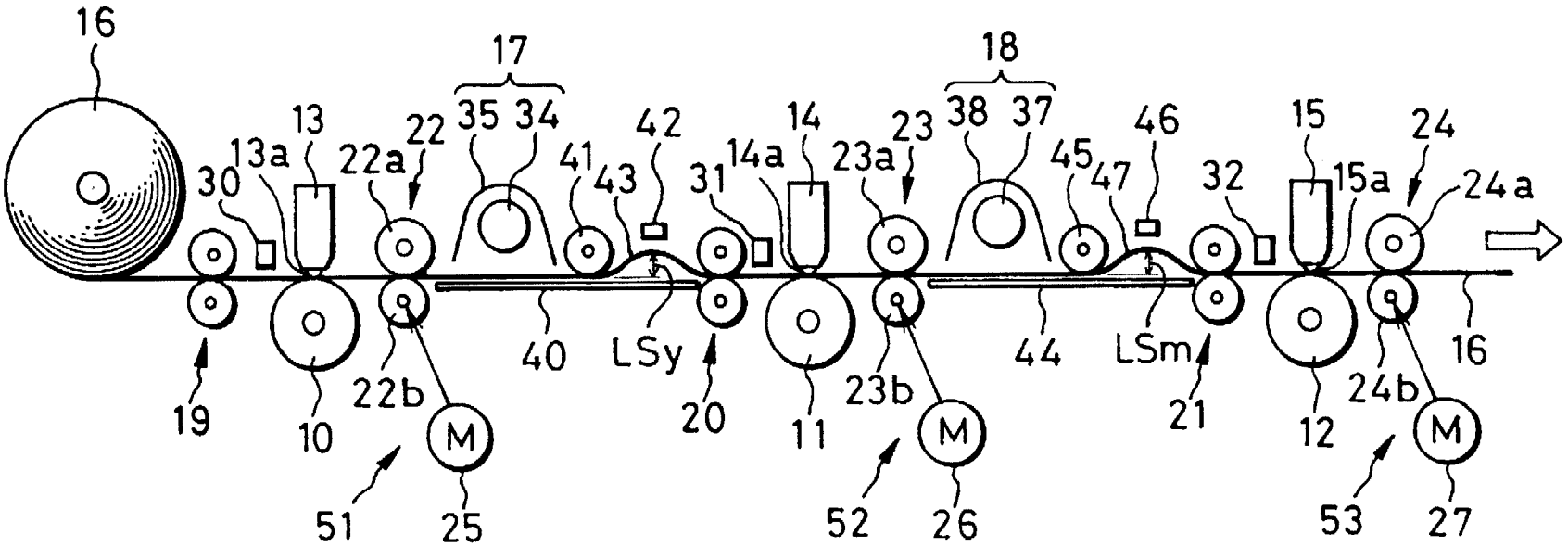
FIG. 1 is an explanatory view in elevation, schematically illustrating a color thermal printer of a one-pass three-head type according to a first embodiment of the invention.

In FIG. 1, three platen rollers 10, 11 and 12 having parallel axes to one another are disposed at appropriate intervals along a transport path of a color thermosensitive recording sheet 16 (hereinafter referred to as a recording sheet 16). Thermal heads 13, 14 and 15 for recording yellow, magenta and cyan color separation images are disposed in opposition to the platen rollers 10, 11 and 12, respectively. Thee pairs of guide rollers 19, 20 and 21 having parallel axes to the platen rollers 10 to 12 are disposed respectively before the platen rollers 10 to 12 in view of a transport direction of the recording sheet 16. Also, three pairs of feed rollers 22, 23 and 24 having parallel axes to the platen rollers 10 to 12 are disposed respectively behind the platen rollers 10 to 12 in the transport direction. Each feed roller pair 22, 23 or 24 consists of a pinch roller 22*a*, 23*a* or 24*a* and a capstan roller 22*b*, 23*b* or 24*b*. The capstan rollers 22*b*, 23*b* and 24*b* are each individually rotated by pulse motors 25, 26 and 27. Thus, the recording sheet 16 is withdrawn from a supply roll and is fed serially to the thermal heads 13 to 15.

Between the first guide roller pair 19 and the yellow recording thermal head 13 (hereinafter referred to as the first thermal head 13), a leading end sensor 30 is disposed for detecting a leading end of the recording sheet 16. The leading end sensor 30 may be an optical sensor having a light-emitting member and a light-receptive member disposed on opposite sides of the transport path of the recording sheet 16, to detect the leading end of the recording sheet 16 responsive to an interruption of light from the light-emitting member. The leading end sensor 30 may be a reflective optical sensor having light-emitting and light-receptive members on the same side of the transport path.

Similar leading end sensors 31 and 32 to the leading end sensor 30 are disposed immediately behind the guide roller pairs 20 and 21, respectively. By counting motor drive pulses supplied to the pulse motor 25 from the time when the leading end is detected by the leading end sensor 30, the position of the recording sheet 16 in the transport path is determined. Also, a print start position on the recording sheet 16 for the first thermal head 13 is determined based on the count of the motor drive pulses. In the same way, a print start position for the magenta recording thermal head 14 (hereinafter referred to as the second thermal head 14) is determined by counting motor drive pulses supplied to the pulse motor 26 upon the leading end being detected by the leading end sensor 31. So is determined a print start position for the cyan recording thermal head 15 (hereinafter referred to as the third thermal head 15) by counting motor drive pulses to the pulse motor 27 upon detection of the leading end by the leading end sensor 32.

The thermal heads 13 to 15 have respective heating element arrays 13*a*, 14*a* and 15*a*, each array consisting of a great number of heating elements. The heating element arrays 13*a*, 14*a* and 15*a* extend axially to the platen rollers 10 to 12. Hereinafter, the axial direction of the platen rollers 10 to 12 will be referred to as a main scan direction, while the transport direction perpendicular to the main scan direction will be referred to as a sub scan direction. The thermal heads 13 to 15 are movable between an upper retracted position and a lower actuating position by solenoids or the like. In the retracted position, the thermal heads 13 to 15 are set away from the recording sheet 16. In the actuating position, the heating element arrays 13*a*, 14*a* and 15*a* of thermal heads 13 to 15 get into contact with the recording sheet 16 and press it onto the platen rollers 10 to 12, respectively.

An optical fixing device 17 for yellow is disposed between the first and second thermal heads 13 and 14. The optical fixing device 17 is constituted of a lamp 34 radiating ultraviolet rays having an emission peak at 420 nm, and a reflector 35. An optical fixing device 18 for magenta is disposed between the second and third thermal heads 14 and 15. The optical fixing device 18 is constituted of a lamp 37 radiating near-ultraviolet rays having an emission peak at 365 nm, and a reflector 38.

A guide plate 40 and a guide roller 41 are disposed on opposite sides of the transport path between the optical fixing device 17 and the guide roller 20. On the guide plate 40, the recording sheet 16 forms a slack 43 due to a difference in transporting speed between the feed roller pairs 22 and 23. A slack sensor 42 is disposed above the guide plate 40 so as to measure a height LSy as a value representative of the magnitude or amount of the slack 43. Similarly, a guide plate 44 and a guide roller 45 are disposed on opposite sides of the transport path between the optical fixing device 18 and the guide roller 21. On the guide plate 44, the recording sheet 16 forms a slack 47 due to a difference in transporting speed between the feed roller pairs 23 and 24. A slack sensor 46 is disposed above the guide plate 44 so as to measure a height LSy as a value representative of the magnitude of the slack 47. The slack sensors 42 and 46 may be micro-displacement gages each having a light-emitting member and a light-receptive member disposed for receiving light reflected from the recording sheet 16.

Thanks to the slacks 43 and 47 between the thermal heads 13 to 15, a change in load to the recording sheet 16, which is caused by contact and removal as well as activation and deactivation of any of the thermal heads 13 to 15, will not affect the transporting speed of the recording sheet 16 in the other recording portions where the other thermal heads are currently recording.

Figure 2:
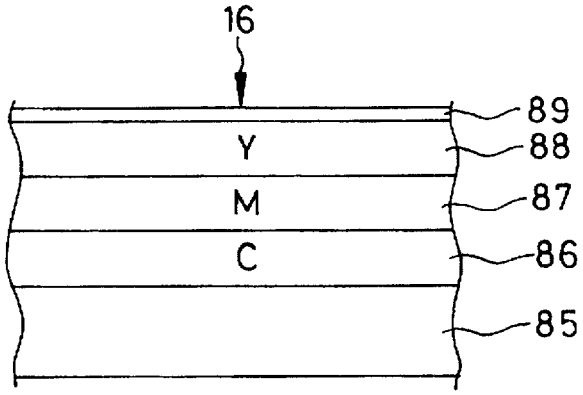
FIG. 2 is an explanatory sectional view schematically illustrating layered construction of the recording sheet.

FIG. 2 shows an example of layered structure of the recording sheet 16, wherein a thermosensitive cyan recording layer 86, a thermosensitive magenta recording layer 87, a thermosensitive yellow recording layer 88 and a protection layer 89 are formed on a support material 85 in this order from reverse to obverse. For easy understanding, "C", "M" and "Y" are shown in the thermosensitive cyan, magenta and yellow recording layers 86, 87 and 88, respectively. The recording layers 86 to 88 have the higher thermal sensitivities the closer to the obverse. The order of the recording to the recording layers 86 to 88 depends on the thermal sensitivity, that is, from the obverse toward the reverse recording layers 88 to 86. Therefore, if an alternative recording sheet for use with the printer has a structure where the yellow recording layer and the magenta coloring layer are interchanged, then its recording order is "magenta-yellow-cyan".

As the support material 85, an opaque coating paper or plastic film is used. But when making a print for use with an over head projector, a transparent plastic film is used as the support material 85. In practice, there are not-shown intermediate layers between the recording layers 86 to 88 so as to adjust the thermal sensitivities of the magenta and cyan recording layers 87 and 86.

Figure 3:
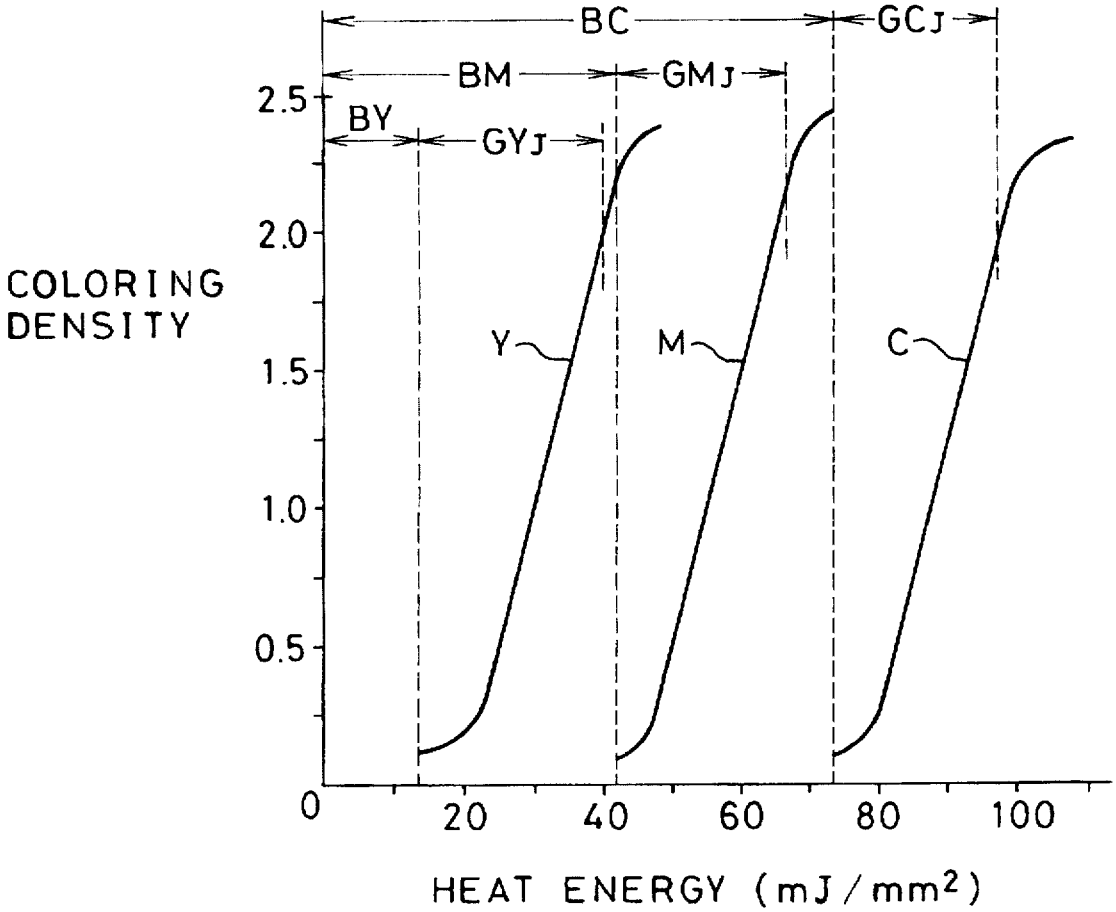
FIG. 3 is a graph illustrating thermal sensitivities of yellow, magenta and cyan recording layers of the recording sheet shown in FIG. 2.

As shown in FIG. 3, the yellow recording layer 88 requires a smallest heat energy for coloring, whereas the cyan thermosensitive coloring layer 87 requires a largest heat energy for coloring. For the yellow recording layer 88, the coloring heat energy applied thereto is a sum of a constant bias heat energy BY and an image heat energy GYj determined by a gradation level "J" of each pixel. The bias heat energy BY has such a level that the yellow recording layer 88 is about to be colored. Also, the coloring heat energy for the magenta recording layer 87 is a sum of constant bias heat energy BM and an image heat energy GMj, and the coloring heat energy for the cyan recording layer 86 is a sum of constant bias heat energy BC and an image heat energy GCj.

The cyan recording layer 86 contains an electron donating dye precursor and an electron accepting compound as main components, and is colored cyan when it is heated. The magenta recording layer 87 contains a diazonium salt compound having a maximum absorption factor at a wavelength of about 365 nm and a coupler which acts upon the diazonium salt compound and is developed in magenta when it is heated. The magenta recording layer 87 loses its capacity of color-developing when it is exposed to electromagnetic or near-ultraviolet rays of about 365 nm, because the diazonium salt compound is photochemically decomposed by this range of rays. The yellow recording layer 88 contains a second diazonium salt compound having a maximum absorption factor at a wavelength range of about 420 nm and a coupler which acts upon the second diazonium salt compound and is colored in yellow when it is heated. The yellow recording layer 88 is also optically fixed, that is, loses its capacity of color-developing when it is exposed to ultraviolet rays of about 420 nm.

Figure 4:
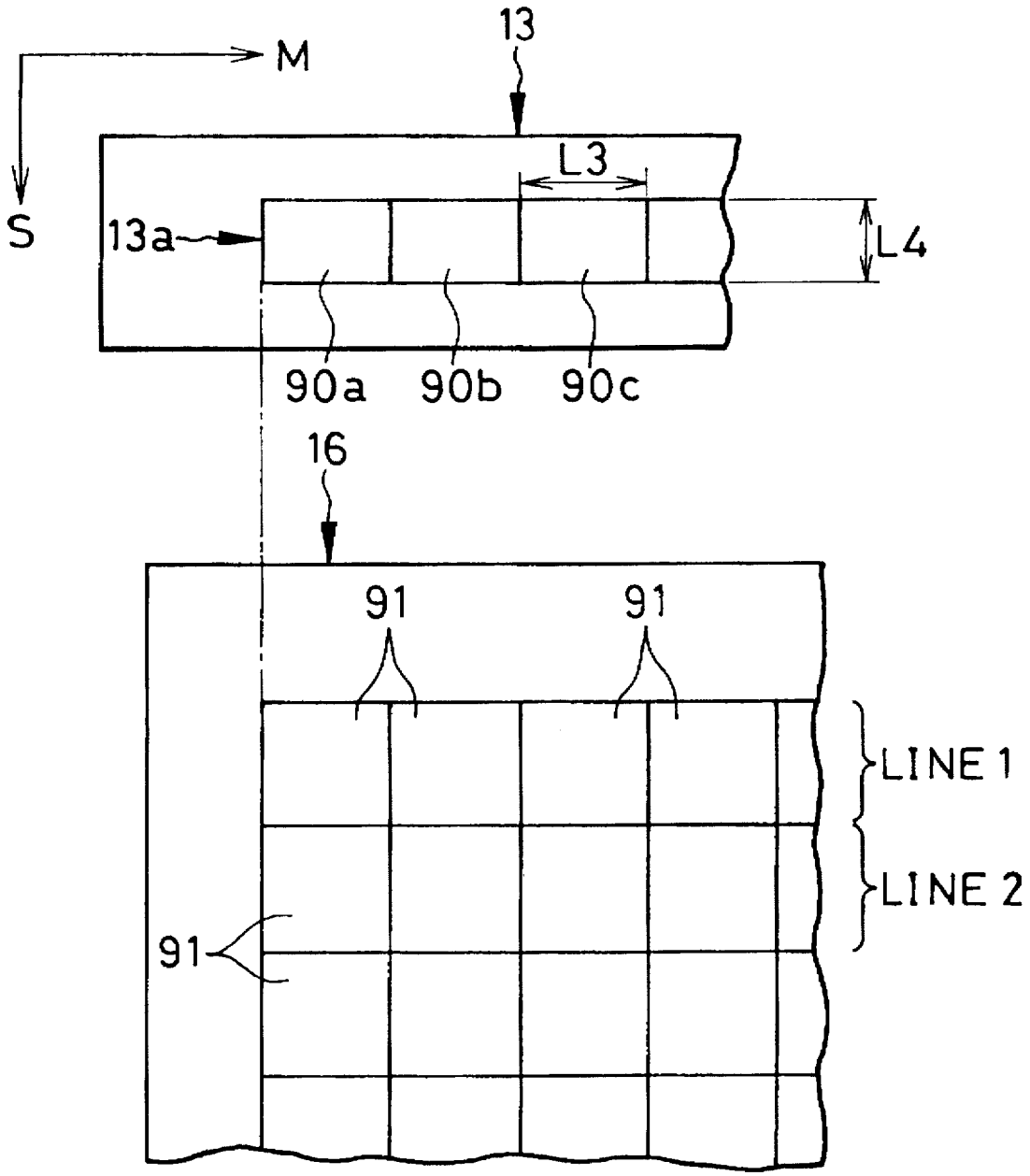
FIG. 4 is an explanatory view illustrating a relationship between an array of heating elements of the yellow recording thermal head and lines of pixels of an image.

As shown in FIG. 4, the heating element array 13*a* of the first thermal head 13 includes a great number of heating elements 90*a*, 90*b*, 90*c* . . . arranged in a line which extends in the main scan direction M. Each of the heating elements 90*a*, 90*b*, 90*c* . . . has a length L3 in the main scan direction M and a length L4 in the sub scan direction S. For example, the lengths L3 and L4 are 140 μm and 100 μm. By moving the recording sheet 16 stepwise at a constant stride in the sub scan direction L relative to the thermal head 13, a line of pixels 91 extending in the main scan direction M and corresponding in number to the heating elements 13*a* are recorded one line after another. The second and third thermal heads 14 and 15 may have the same construction as the first thermal head 13.

Figure 5:
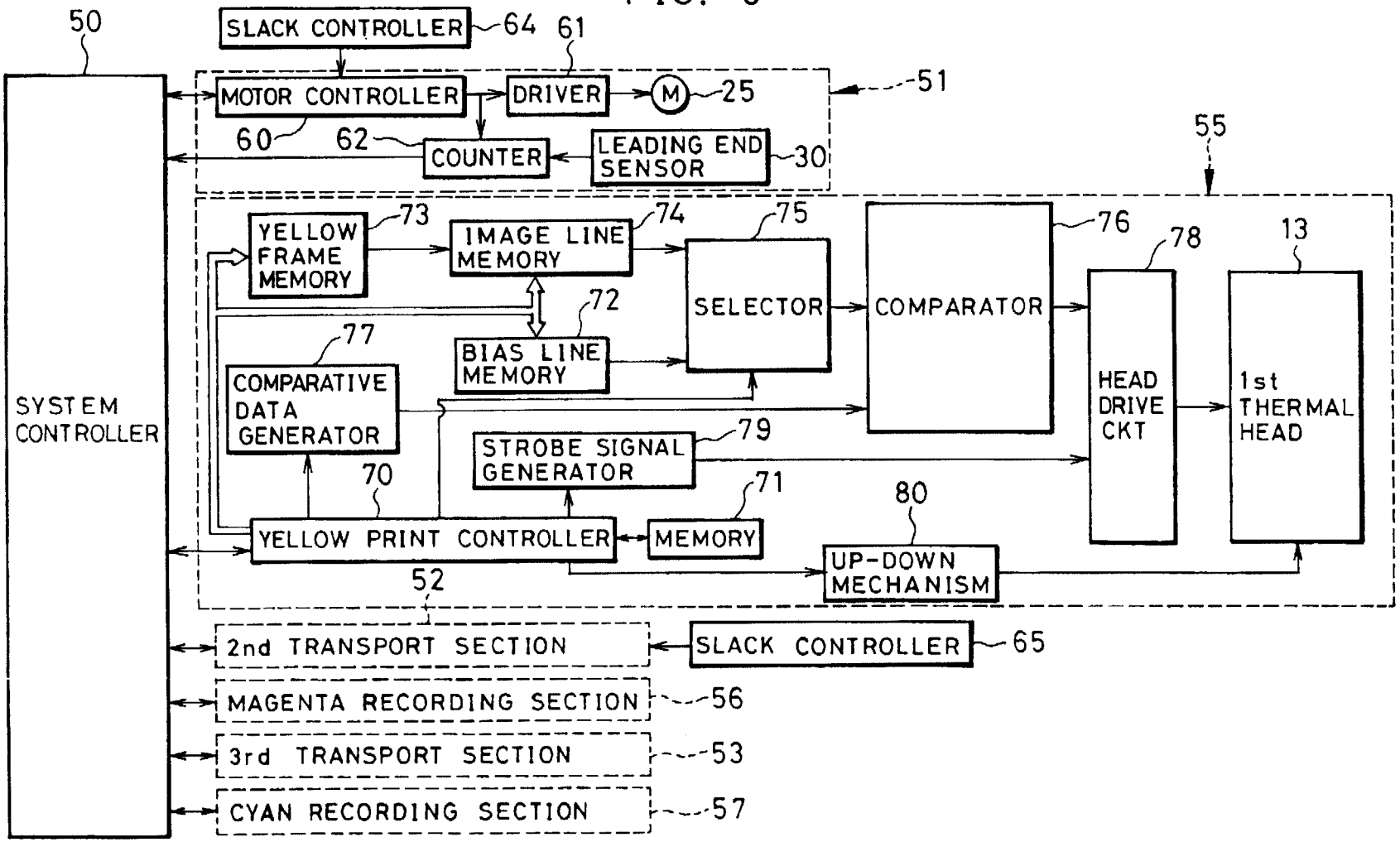
FIG. 5 is a block diagram of the circuitry of the color thermal printer shown in FIG. 1.

Referring to FIG. 5 showing the circuitry of the thermal printer, a system controller 50 sequentially controls first to third transport sections 51 to 53 and yellow, magenta and cyan recording sections 55, 56 and 57. The first transport section 51 is to transport the recording sheet 16 for the yellow frame recording, the second transport section 52 is to transport the recording sheet 16 for the magenta image recording, and the third transport section 53 is to transport the recording sheet 16 for the cyan image recording. The system controller 50 controls start and stop of the pulse motor 25 through a motor controller 60 of the first transport section 51. The motor controller 60 outputs motor drive pulses with a constant cycle to a motor driver 61, thereby to rotate the pulse motor 25 at a constant speed.

A counter 62 starts counting the motor drive pulses from the time when the leading end sensor 30 detects the leading end of the recording sheet 16, so as to determine the position of the leading end of the recording sheet 16 being in transport. To determine when to move down and move up the respective thermal heads 13 to 15, as well as when to activate and deactivate the thermal heads 13 to 15, the count of the counter 62 is sent to the system controller 50. The second and third transport sections 52 and 53 are constructed in the same way as the first transport section 51.

Figure 6:
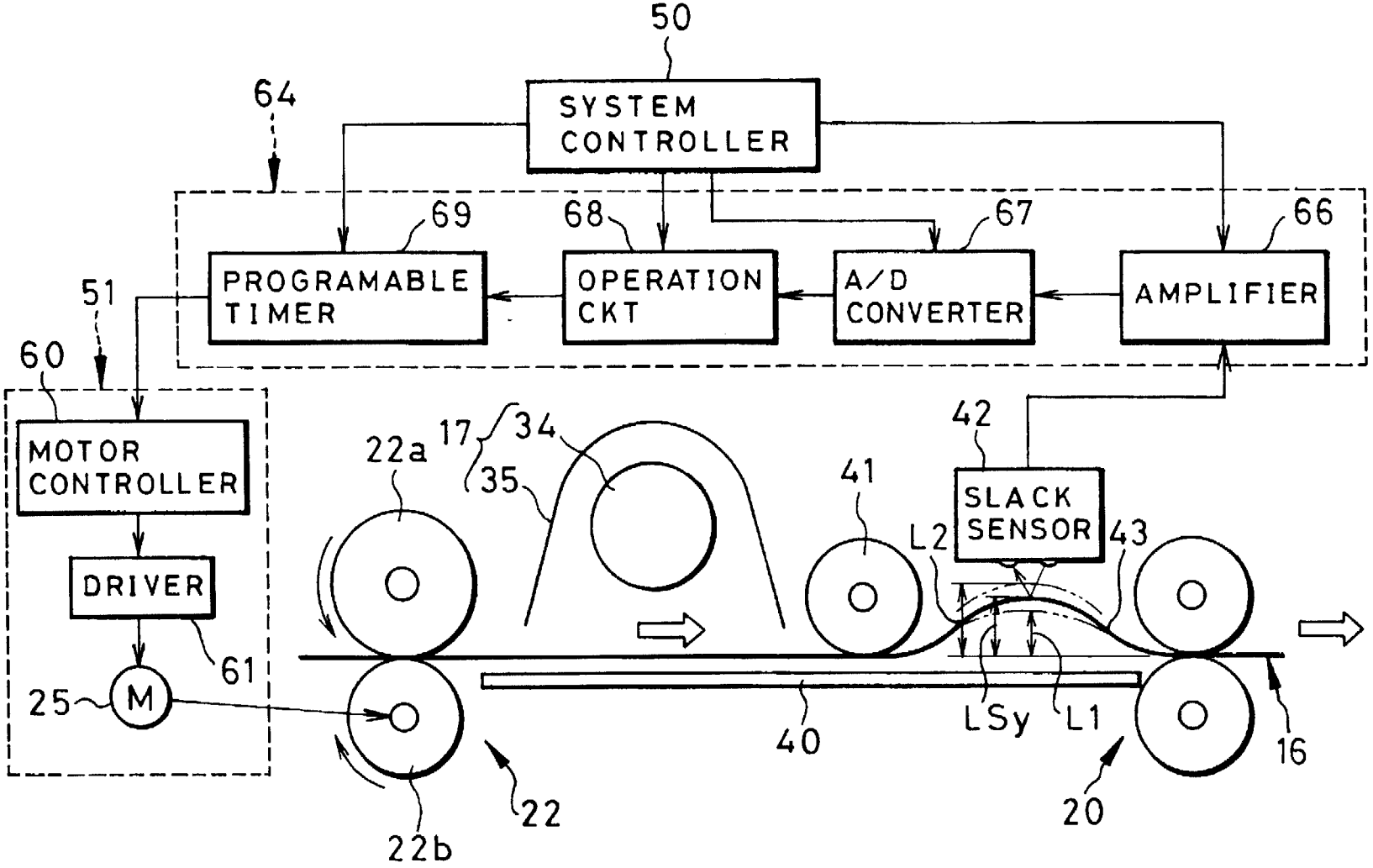
FIG. 6 is an explanatory view, schematically illustrating the slack controller of the color thermal printer shown in FIG. 1.

As shown in FIG. 6, a slack controller 64 is connected to the motor controller 60 of the first transport section. The slack controller 64 makes fine control of transporting speed of the recording sheet 16 by adjusting pulse rate of the motor drive pulses, in order to form the slack 43 on the guide plate 40 and keep the height LSy of the slack 43 in a range of more than L1 to less than L2, wherein L1 and L2 are predetermined reference values. A signal from the slack sensor 42, which is representative of the height LSy, is amplified by an amplifier 66 up to a voltage level which is suitable for analog-to-digital conversion in an A/D converter 67. The digital signal is sent to an operation circuit 68.

The operation circuit 68 averages the digital slack sensor output signals and makes non-linearity correction to convert the average value to a length LSy' of the slack 43 which corresponds to the height LSy. Then, the operation circuit 68 compares the length LSy' corresponding with reference lengths L1' and L2' corresponding to the reference heights L1 and L2. If the value LSy' is not less than the value L2', the operation circuit 68 outputs the excess as a load value to a programmable timer 69. If the value LSy' is not more than the value Li', the operation circuit 68 outputs the shortage as a load value to the programmable timer 69. It is alternatively possible to omit conversion of the slack sensor output signal to the height LSy, and control the amount of slack directly based on the slack sensor output signal.

Responsive to the load value corresponding to the excess of the slack 43, the programmable timer 69 lowered the pulse rate of the motor drive pulses. Thus, the transporting speed of the capstan roller 22*b* for the recording sheet 16 is slightly lowered in comparison with that of the capstan roller 23*b*, so that the slack 43 is reduced to the predetermined range. When the load value represents the shortage of the slack 43, the programmable timer 69 raises the pulse rate of the motor drive pulses, to raise the transporting speed of the capstan roller 22*b* relative to that of the capstan roller 23*b*. Thus, the slack 43 increases till the height LSy goes above the height L1. A slack controller 65 having the same construction as the slack controller 64 is connected to a not-shown motor controller of the second transport section 52, so as to maintain the height LSm of the slack 47 in a predetermined range, i.e. L1<LSm<L2.

Figure 7:
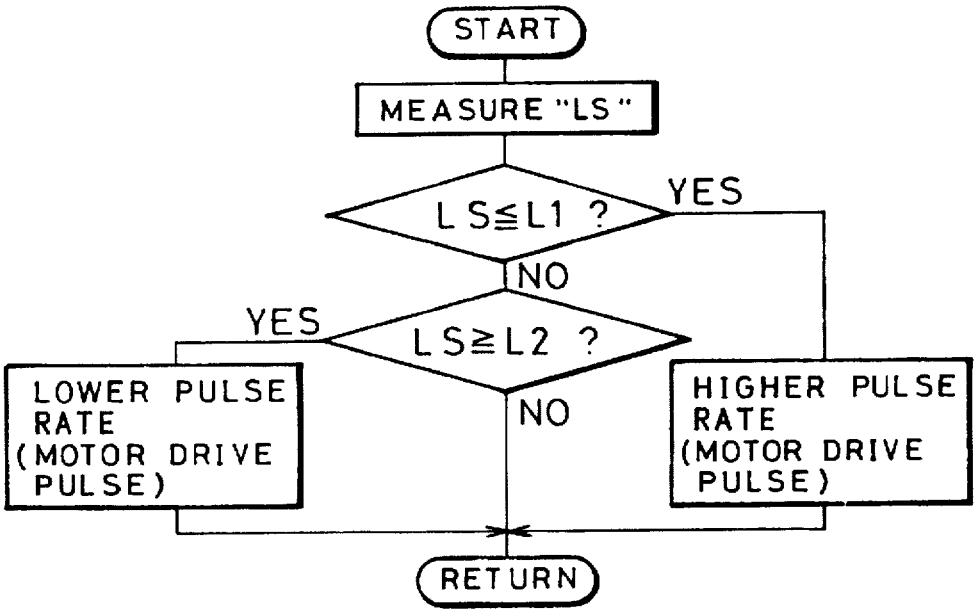
FIG. 7 is a flow chart illustrating a sequence for keeping a slack of the recording sheet in a given length range.
Figure 8:
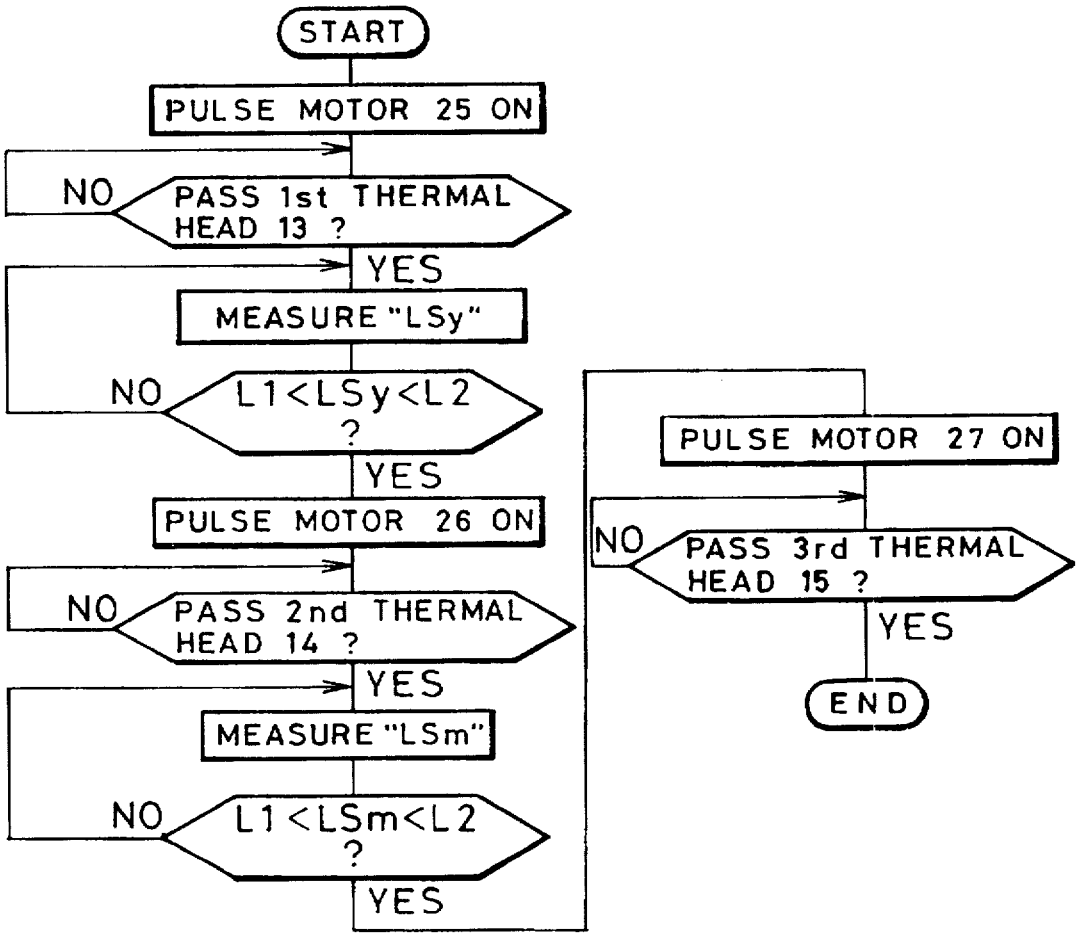
FIG. 8 is a flow chart illustrating a sequence for presetting slack portions in the recording sheet.

FIG. 7 shows a flow chart illustrating the above-described operation of the slack controllers 64 and 65. FIG. 8 shows a flow chart illustrating an initial operation of the slack controllers 64 and 65 for setting-up the slacks 43 and 47 while the leading end of the recording sheet 16 passes the first to third thermal heads 13 to 15.

As shown in FIG. 5, the system controller 50 controls the yellow recording section 55, the magenta recording section 56 and the cyan recording section 57 with reference to the counts of the respective counters of the first to third transport sections 51 to 53. Specifically, the system controller 50 controls up-and-down of the thermal heads 13 to 15, and outputs a line print start signal to each of the thermal heads 13 to 15 for designating a start of printing of one line.

Responsive to the line print start signal, a yellow print controller 70 of the yellow recording section 55 starts printing one line of the yellow image. Accordingly, the number of lines having been recorded can be determined by counting the number of line print start signal having been applied to the yellow print controller 70. The magenta and cyan recording sections 56 and 57 have the same construction as the yellow recording section 55, and operate in the same way as the yellow recording section. Therefore, the following description relates only to yellow recording section 55, but applies to the magenta and cyan recording sections 56 and 57.

A memory 71 stores bias data and other data necessary for yellow recording. The bias data is commonly used for every heating elements 90*a*, 90*b*, 90*c* . . . of the yellow thermal head 13. Based on the common bias data, bias data of one line is formed. A bias line memory 72 is revised each time the type of the bias data changes. Unless the type of the bias data is changed, the same bias data is commonly used for every line. However, as the heating elements have inevitable variations in resistance, heat energy generated from one heating element can differ from that from another heating element even in response to the same drive pulse. To compensate for the resistance variation, it is desirable to predetermine specific bias data to each heating element.

A yellow frame memory 73 stores yellow image data per frame, which is inputted through a video camera or a scanner. The yellow frame memory 73 is read line by line during the yellow image recording. The yellow image data per line is sequentially written in an image line memory 74. Alternatively, it is possible to write blue frame data in a frame memory and convert it line by line into yellow image data after the blue frame data is read line by line.

A selector 75 first selects the bias line memory 72 to serially send the bias data of one line to a comparator 76 in the order of the pixels. Next, the selector 75 selects the image line memory 74 to serially send the yellow image data of one line to the comparator 76.

A comparative data generator 77 generates a series of comparative data to the comparator 76. If the image data have 256 tonal steps, the series of comparative data is from "0" to "255" in decimal notation. The comparator 76 compares the bias data and the image data with the comparative data. As a result, the bias data is converted into 256-bit bias drive data per one pixel, and the image data is converted into 256-bit image drive data per one pixel.

A head drive circuit 78 provides logical products of the drive data from the comparator 76 and strobe pulses from a strobe signal generator 79. Thus, a drive pulse having the same width as the strobe pulse is generated when the binary drive data has a value "1". When the binary drive data has a value "0", no drive pulse is generated. The width of the strobe pulse varies depending upon whether it is for bias heating or image heating, and according to color to be printed, i.e., depending upon the thermal sensitivities of the recording layers 86 to 88. Generally, the strobe pulse has a larger width for bias heating than that for image heating.

An up-down mechanism 80 moves the first thermal head 13 between the actuating position where the first thermal head 13 presses the heating element array 13*a* onto the recording sheet 16, and the retracted position where the heating element array 13*a* is removed away from the recording sheet 16. A predetermined time after the contact of the first thermal head 13 with the recording sheet 16, which is taken to get the transport of the recording sheet 16 into a stable condition, the heating element array 13*a* start to be supplied with electric power. Also, the first thermal head 13 is not removed from the recording sheet 16 until the recording sheet 16 has been transported by a predetermined number of lines after the power supply to the heating element array 13*a* stops. The up-down mechanism 80 may be a cam mechanism or a solenoid.

It is possible to start applying bias heating energy to the recording sheet 16 before the leading margin of the print area reaches under the thermal head 13. This makes the change in load to the recording sheet 16 gentler at the start of printing.

Now the operation of the thermal printer as set forth above will be described.

First, three color separation frames of a full-color image are written in the respective color frame memories. Thereafter when a print start switch (not-shown) is turned on, the system controller 50 turns the optical fixing devices 17 and 18 on, and causes a paper feeding mechanism (not-shown) to feed the recording sheet 16. The system controller 50 also commands the motor controller 60 to start driving the pulse motor 25. The motor controller 60 then supplies the motor drive pulses at constant intervals so as to rotate the pulse motor 25 at a constant speed. As a result, the first pair of guide rollers 22 are rotated at a constant speed. The feed rollers of each pair 19 to 21 do not nip the recording sheet 16 until the leading end of the recording sheet 16 has passed therebetween. The recording sheet 16 is withdrawn from the roll by a pair of feed rollers (not-shown) which is rotated by a not-shown motor, toword the transporting system.

While the recording sheet 16 is being transported toward the platen roller 10 through the guide rollers 19, the leading end sensor 30 detects the leading end of the recording sheet 16. Upon the detection signal form the leading end sensor 30, the counter 62 starts counting the motor drive pulses in order to measure the transported position of the recording sheet 16.

The system controller 50 always monitors the count of the counter 62 and, when it determines based on the count that the leading end of the recording sheet 16 reaches a predetermined position behind the first thermal head 13, commands the yellow print controller 70 to move down the first thermal head 13. Then, the yellow print controller 70 causes the up-down mechanism 80 to move the first thermal head 13 down to press the heating element array 13*a* onto the recording sheet 16. According to the present embodiment, once the leading end of the recording sheet 16 has passed the first to third thermal heads 13 to 15, the thermal heads 13 to 15 continue to press the recording sheet 16 while a predetermined number of full-color images are successively printed.

After the first thermal head 13 gets into contact with the recording sheet 16, the yellow print controller 70 reads out yellow image data of the first line from the yellow frame memory 73, and write the yellow image data in the image line memory 74. Simultaneously, the bias data is read out from the memory 71 and is written in the bias line memory 72.

The system controller 50 has a memory which is written with a distance from the leading end to the leading margin of the print area of the recording sheet 16 through a not-shown keyboard or during the manufacture of the thermal printer. The system controller 50 commands the yellow print controller 70 to start yellow image recording when it determines based on the count of the counter 62 that the leading margin of the print area is placed under the heating element array 13*a* of the first thermal head 13.

Then, the yellow print controller 70 connects the selector 75 to the bias line memory 72 to read bias data of one line. For instance, the bias data of one pixel has a value "240" in decimal notation. The bias data of one line is serially sent to the comparator 76. Simultaneously, the yellow print controller 70 resets a counter of the comparative data generator 77, so that the comparative data generator 77 first outputs a value "0" in decimal notation as the comparative data to the comparator 76.

The comparator 76 compares the bias data with the comparative data, and outputs binary "1" as a bit of the 256-bit bias drive data when the bias data is larger than the comparative data. Therefore, the comparator 76 serially outputs binary "1" for every pixel of one line when the comparative data is "0".

Figure 9A:
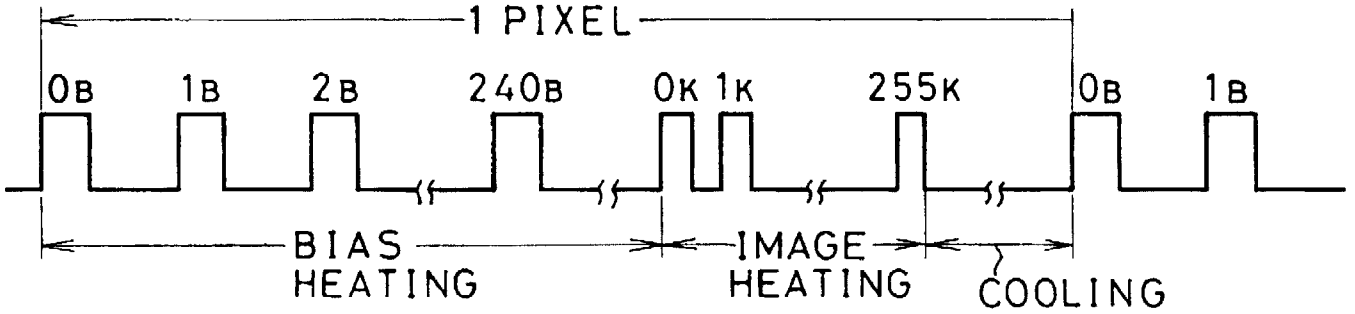
FIGS. 9A, 9B and 9C are timing charts of drive pulses applied respectively to the yellow, magenta and cyan recording thermal heads.

The serial drive data from the comparator 76 is converted into a parallel form through a not-shown shift register of the head drive circuit 78. The head drive circuit 78 outputs a bias drive pulse for each pixel as a logical product of the parallel drive data and the strobe pulse from the strobe signal generator 79. Since the drive data is "1" for every pixel of one line in its initial bit, a drive pulse $O_B$ having the same width as the strobe pulse is simultaneously outputted to every heating element of the heating element array 13*a*. As a result, all the heating elements are heated simultaneously. FIG. 9A shows a drive pulse train applied to one of the heating elements 90*a*, 90*b*, 90*c* and so forth.

Next, the comparative data generator 77 outputs "1" in decimal notation as the comparative data of one line. Then, the bias data of one line is serially read out from the bias line memory 72 for the second time, and is compared with the comparative data to produce a second bias drive pulse for every heating element of the heating element array 13*a*, in the same way as for the initial bias drive pulse of each train.

In this way, every heating element of the heating element array 13*a* is supplied with 241 bias drive pulses to radiate the bias heating energy BY for the yellow recording layer 88.

When the bias heating is complete, image heating is started. First, the yellow print controller 70 resets the counter of the comparative data generator 77 to zero, so that the comparative data generator 77 newly starts outputting comparative data from "0" to "255". Simultaneously, the selector 75 is switched to the image line memory 74. Next, the yellow print controller 70 reads the yellow image data of the first line from the image line memory 74 to send it one pixel after another to the comparator 76.

The comparator 76 sequentially compares the yellow image data of one line with each value of the comparative data "0" to "255" in decimal notation. Since the image data of one pixel has a value in a range from "0" to "255" in decimal notation, and the comparator 76 outputs "1" only when the image data is larger than the comparative data, 256-bit image drive data is generated for the yellow image data of one pixel in the same way as for the bias data. The image drive data of one line is sent in serial to the head drive circuit 78, to be converted into a parallel form, and then converted into image drive pulses for the heating element array 13*a* by using strobe pulses of a width predetermined for yellow image recording. Thus, the heating elements 90*a*, 90*b*, 90*c* and so forth are supplied with different numbers of image drive pulses corresponding to the associated yellow image data, to radiate a variable image heating energy GYj each.

To record a pixel at a highest density, the image data of that pixel is "255", and the associated heating element is supplied with 256 image drive pulses $0_K$ to $255_K$, as is shown in FIG. 9A. To record a pixel at a lowest density, the corresponding image data is "0", and no image drive pulse is supplied to the associated heating element. According to the applied image heating energy GYj, the yellow recording layer 88 is colored to develop a dot at a variable density in each pixel 91.

After the image heating, each heating element is cooled by not being heated for a period. The cooling period varies depending upon the number of preceding image drive pulses, and is determined such that even for the heating element that has been heated with the largest number "256" of image drive pulses, a time enough to cool the heating element down to a given temperature at the room temperature may be provided.

After all of the heating elements of the array 13*a* get into the cooling period, the yellow print controller 70 reads out the yellow image data of the second line from the yellow frame memory 73 and writes it in the image line memory 74. Also, the selector 75 is switched to the bias line memory 72. The bias line memory 72 continues to store the same bias data as before, except for a case to print a specific line.

At the end of the cooling period, the system controller 50 newly outputs the line print start signal to the yellow print controller 70, to start printing the second line of the yellow frame. The second and following lines of the yellow frame are sequentially recorded in the same way as for the first line.

While the first thermal head 13 is driven to record the yellow image in this way, the recording sheet 16 is transported line by line in the sub scan direction through the rotation of the platen roller 10 and the feed rollers 22. Then, the portion of the recording sheet 16 where the yellow image has been printed is moved under the optical fixing device 17, so that the yellow recording layer 88 is optically fixed by the ultraviolet rays of about 420 nm.

The system controller 50 monitors the count of the second transport section 52 that corresponds to the number of motor drive pulses supplied to the pulse motor 25 from the time when the leading end sensor 31 detects the leading end of the recording sheet 16. When the system controller 50 determines based on the count of the second transport section 52 that the recording sheet 16 reaches the second thermal head 14, the system controller 50 causes the magenta recording section 56 to move the second thermal head 14 down to the actuating position. Thereafter when it is determined that the leading margin of the print area reaches the second thermal head 14, the system controller 50 commands the magenta recording section 56 to start printing. Thus, the first line of a magenta frame is recorded over the first line of the yellow frame.

Figure 9B:
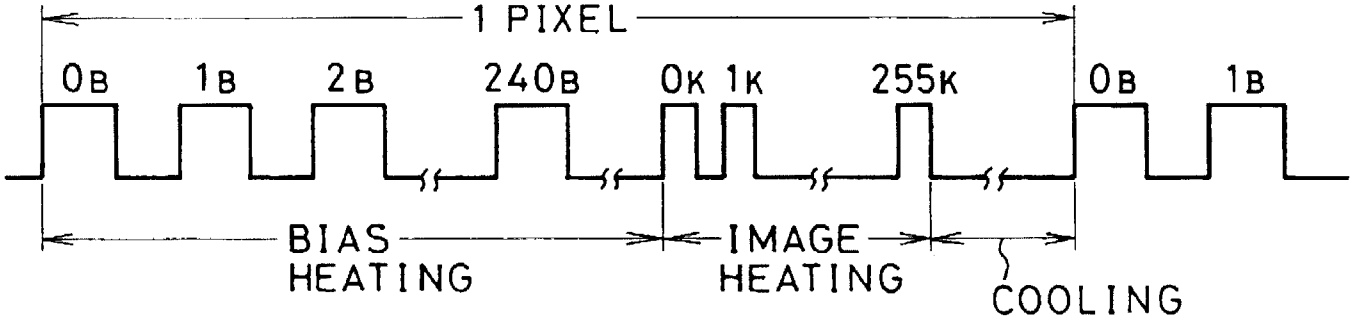
Figure 9C:
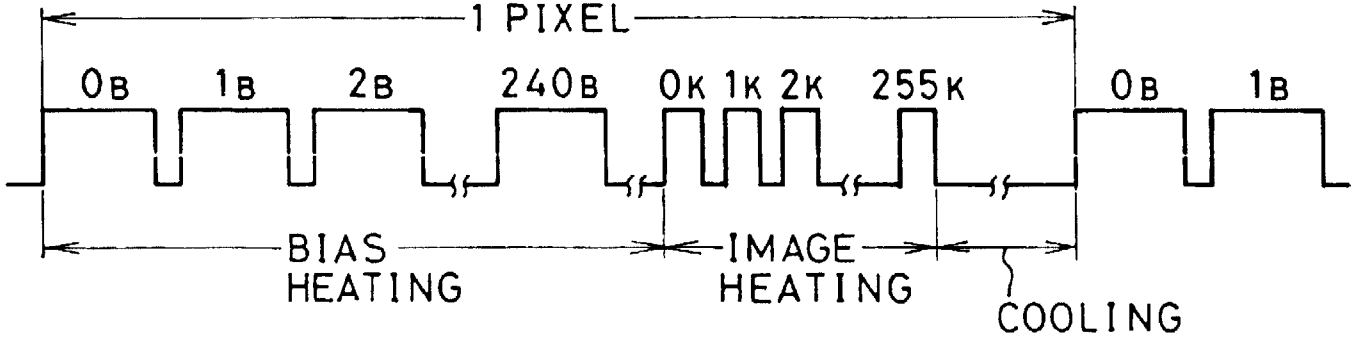

When recording a magenta pixel, one of the heating elements of the second thermal head 14 is supplied with 240 bias drive pulses to radiate the bias heating energy BM for the magenta recording layer 87. As the bias heating energy BM is larger than the bias heating energy BY for the yellow recording layer 88, the width of strobe pulses for the magenta recording and thus the width of the bias drive pulses for the second thermal head 14 are longer than those for the first thermal head 13 for the yellow recording, as shown in FIG. 9B.

After the bias heating, the heating elements of the second thermal head 14 are supplied with 0 to 256 image drive pulses corresponding in number to the magenta image data, to record magenta pixels to the magenta recording layer 87. The second line of the magenta frame starts to be printed when all the heating elements are cooled down to a given temperature after the image heating for the first line. The second and following lines are recorded in the same way as above. The magenta recording section 56 and the second transport section 52 operate similarly to the yellow recording section 55 and the first transport section 51. The recorded magenta image is successively fixed by being exposed to the near-ultraviolet rays of about 365 nm radiated from the optical fixing device 18.

When the leading end of the recording sheet 16 reaches the third thermal head 15, the system controller 50 causes the third thermal head 15 to press the recording sheet 16. Thereafter when the leading margin of the print area reaches the first thermal head 15, the cyan recording section 57 starts printing.

The cyan recording section 57 drives the respective heating elements of the third thermal head 15 with a constant number, 240 in this instance, of the bias drive pulses and a variable number of image drive pulses, to heat and color-develop the cyan recording layer 86. In this way, the first line of a cyan frame is recorded over the first lines of the yellow and magenta frame. The second and following lines are recorded in the same way as above.

The recording sheet 16 having the full-color images recorded through the first to third thermal heads 13 to 15 in continuous succession is cut into pieces of each individual image.

As described so far, the thermal heads 13 to 15 are set in the retracted positions before the leading end of the recording sheet 16 passes therethrough, and are set in the actuating positions each after the leading end of the recording sheet 16 passed. Thereafter, the thermal heads 13 to 15 are activated and deactivated. Although the up-down movement of the thermal heads 13 to 15 changes the load to the recording sheet 16 in the transport path, the change in the load is absorbed by the slack 43 or 47, so that the change in the load does not affect the recording.

Since the respective quantities of the slack portions 43 and 47 are maintained in the predetermined range by slightly changing the rotational speeds of the feed rollers. The slight change in transport speed results in a slight change in coloring density through it is very small compared with the density change caused by the load change. Therefore, it is preferable to adjust the heating energy to the change in the transport speed of the feed rollers.

Figure 10A:
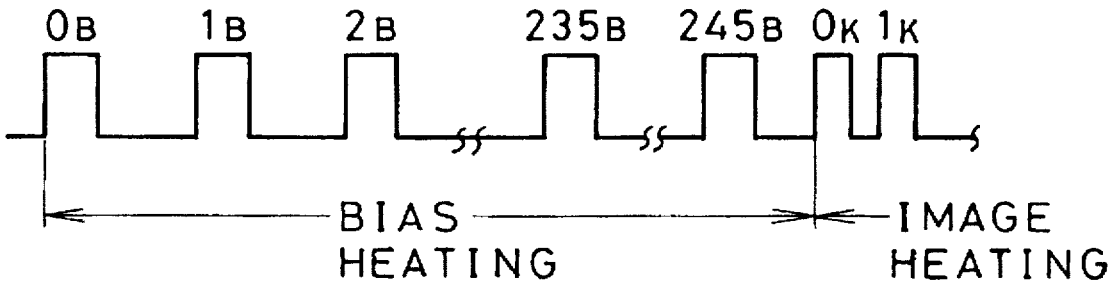
FIGS. 10A and 10B are timing charts illustrating a fine control of bias heating in accordance with a fine control of transporting speed of the recording sheet on making a slack.
Figure 10B:
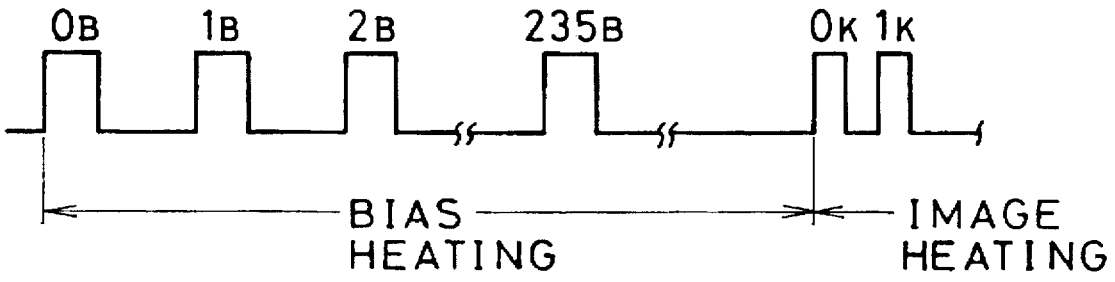

For example, when the rotational speed of the pulse motor 25 is slightly increased by increasing pulse rate of the motor drive pulses in order to increase the quantity or amount of the slack 43, as the shorter time is taken to transport the recording sheet 16 by one line, it is necessary to apply the head drive pulses at a correspondingly higher frequency to each heating element. Then, the total cooling period per line is reduced, so that heat storage can occur in the first thermal head 13, resulting in a higher coloring density. This applies to the pulse motor 26. According to an embodiment, while the transport speed of the pulse motor 25 or 26 is increased, modified bias data having a smaller value, e.g. "235" in decimal notation, is adopted so as to drive each heating element with a smaller number, i.e. 236, of bias drive pulses than usual, as is shown in FIG. 10B.

On the other hand, when the rotational speed of the pulse motor 25 or 26 is decreased, the total cooling period per line is elongated, so that the coloring density would be slightly lowered. Therefore, modified bias data having a larger value, e.g. "245" in decimal notation, is adopted, as is shown in FIG. 10A, while the transport speed of the pulse motor 25 or 26 is lowered. As a result, each heating element is driven with a larger number, i.e., 246 bias drive pulses than usual. In this way, the coloring density is maintained proper even while the transporting speed is slightly changed. The modified bias data may be previously stored in the memory 71, to be written in the bias line memory 72 according need.

Instead of changing the number of bias drive pulses, it is possible to change the number of image drive pulses or both the numbers of bias drive pulses and image drive pulses.

Figure 11:
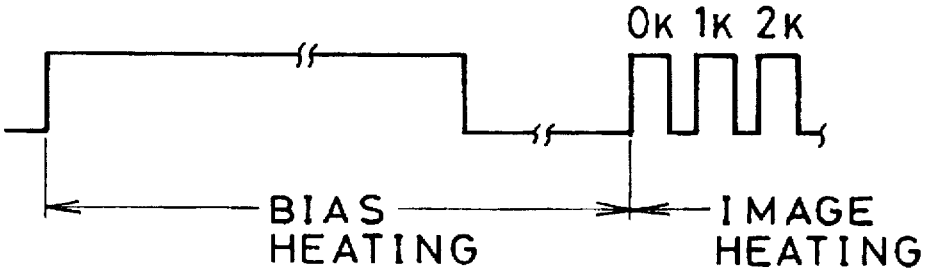
FIG. 11 is a timing chart of drive pulses wherein bias heating is effected by a single bias drive pulse.

In case where a bias drive pulse is used per pixel, as is shown in FIG. 11, the width of the bias drive pulse may be slightly changed so as to prevent the above problem.

Figure 12:
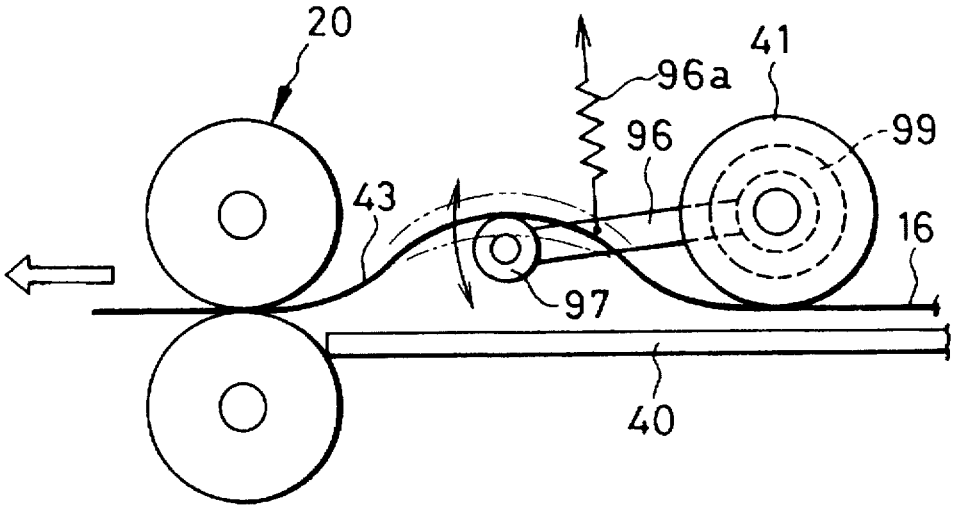
FIG. 12 is an explanatory view illustrating another embodiment of slack sensor for use in a color thermal printer as shown in FIG. 1.

To measure the amount of the slack portions 43 and 47, it is possible to dispose a dancer roller 97 in contact with either of the slack portions 43 and 47, as is shown with respect to the slack 43 in FIG. 12. The dancer roller 97 is supported by an arm 96 which is mounted to a shaft of the guide roller 41 so as to be capable of swinging independently of the guide roller 41. A potentiometer 99 detects the angular position of the arm 96 as a measure of the slack amount. The arm 96 is gently biased upward by a spring 96*a*. The dancer roller 97 may be supported by a sliding guide member or the like so as to be movable up and down in accordance with the increase and decrease of the slack 43 or 47.

It is possible to form a slack portion by controlling the rotational speed of feed rollers in a downstream side of the slack portion, instead of controlling the rotational speed of feed rollers in an upstream side of the slack portion . . . 0082

Although the thermal printer of the above-described embodiment continuously monitors and controls the quantity or amount LS of either of the slack portions 43 and 47 so as to keep it in the predetermined range (L1<LS<L2), it is possible to control the slack amount LS only in those periods when the thermal heads 13 to 15 do not make thermal recording. That is, for example, when the blanks between the print areas are placed under the heating element arrays 13*a*, 14*a* and 15*a* of the thermal heads 13 to 15.

Figure 13:
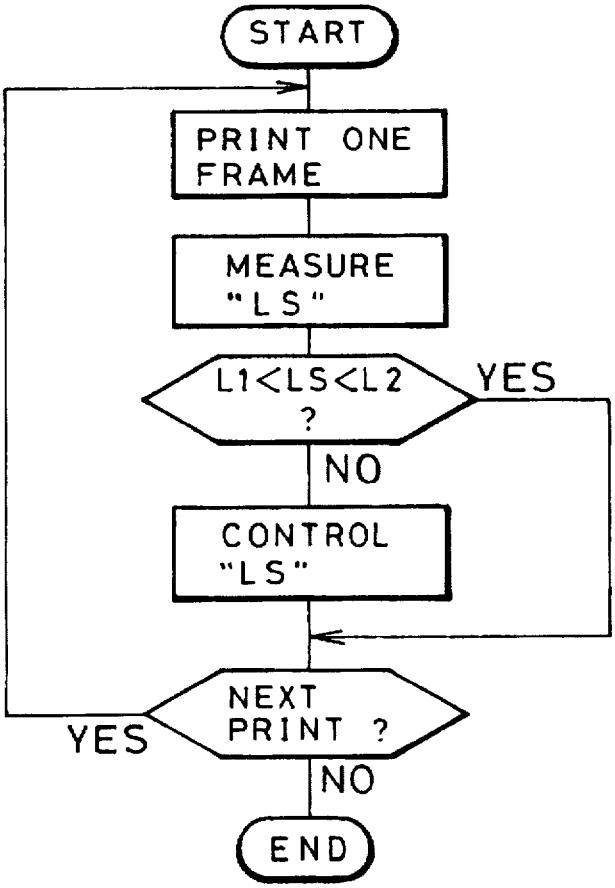
FIG. 13 is a flow chart illustrating a slack control operation of the color thermal printer shown in FIG. 1, according to a second embodiment of the invention.

FIG. 13 shows the flow chart of this embodiment. In this case, the lower limit L1 of the slack amount LS should be large enough to absorb possible variation in transport amount during one-frame recording. It may be possible to control the slack amount in the cooling period after recording one line. Since the fine control of transport speed of the recording sheet 16 for the slack amount control will not affect the recording, it is unnecessary to adjust heat energy from the thermal head to the change in the transport speed.

When a plurality of full-color images are successively printed on the continuous recording sheet 16, as in the above-described embodiment, it is not always possible to exactly determine the leading margin of the print area for each full-color image merely with reference to the leading end of the recording sheet. Therefore, the print start positions of the respective thermal heads 13 to 15 for the same full-color image can deviate from one another, resulting in color registration failure. Moreover, the deviation will increase with the number of printed images.

To avoid this problem, it is preferable to previously provide positioning marks at regular intervals along the recording sheet 16, and determine with reference to the positioning marks the leading margin of each print area or the positions of the recording sheet 16 at which the thermal heads 13 to 15 begin to press it. It is also possible that the thermal printer provides the recording sheet 16 with such positioning marks in the vicinity of the guide rollers 19. The positioning marks may be thermally recorded, or painted in ink. It is possible to provide the marks as notches or punches. In case the positioning marks being painted in ink, it is desirable to dispose them in a side edge of the recording sheet 16. The positioning marks should preferably be disposed in blanks or spacings between the print areas, so that the marks can be cut off with the blanks when the recording sheet 16 is cut into individual pieces of the printed full-color images. In this case, the positioning marks can also serve as indicia for cutting positions.

Figure 14:
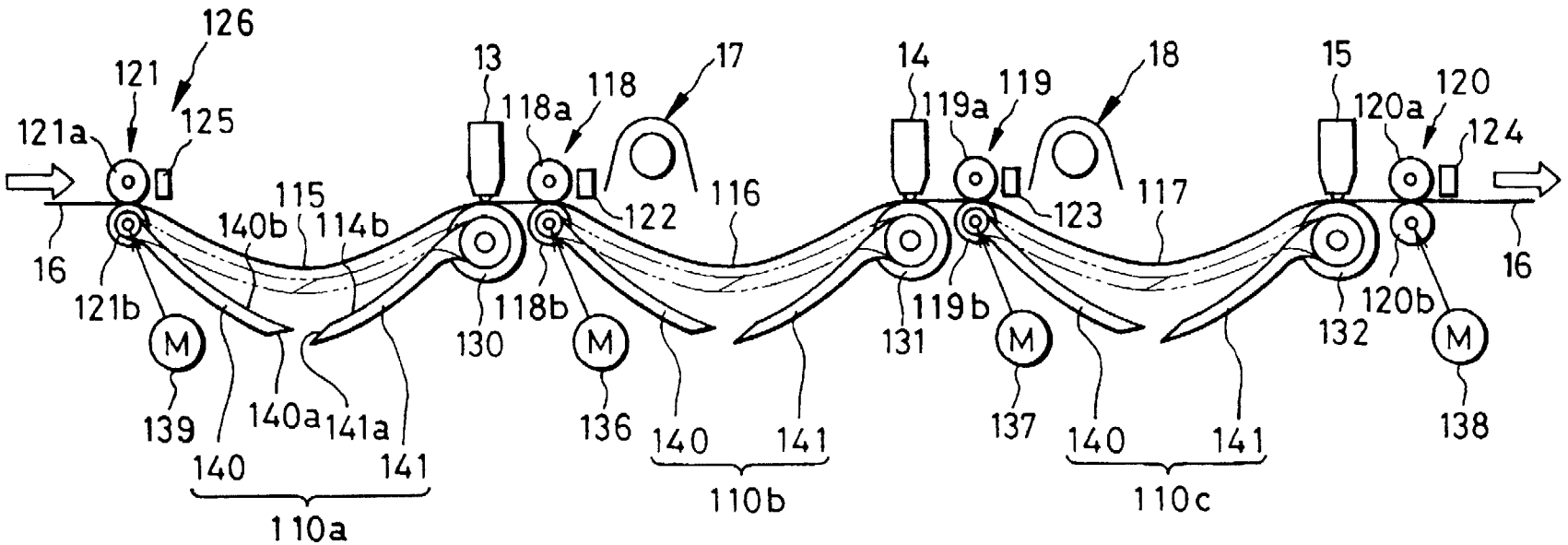
FIG. 14 is an explanatory view illustrating a color thermal printer according to a third embodiment of the invention.

FIG. 14 shows another preferred embodiment of the present invention, wherein paper guide members 110*a*, 110*b* and 110*c* are disposed respectively before the thermal heads 13 to 15 in the transporting direction indicated by arrows. The paper guide members 110*a* to 110*c* each has a concavely curved guide surface relative to a straight horizontal plane between the thermal heads, so that a recording sheet 16 curves to provide slack portions 115, 116 and 117 before each of the thermal heads 13 to 15. Designated by 17 and 18 are optical fixing devices. The thermal heads 13 to 15 are movable up and down through not-shown up-down mechanisms.

Three pairs of feed rollers 118, 119 and 120 are respectively disposed behind the thermal heads 13 to 15. There are a pair of feed rollers 121 and a mark sensor 125 in a paper feed section 126. Each pair of the feed rollers 118 to 121 is constituted of a pinch roller 118*a*, 119*a*, 120*a*, 121*a* and a capstan roller 118*b*, 119*b*, 120*b*, 121*b*. The pinch rollers 118*a* to 121*a* are movable up and down through not-shown sliding frames, to be set each individually in a pinching position or a releasing position. The capstan rollers 118*b*, 119*b*, 120*b* and 121*b* are rotated by motors 136, 137, 138 and 139, respectively.

The recording sheet 16 is provided with not-shown positioning marks at regular intervals. To detect the positioning marks, mark sensors 122, 123 and 124 are disposed behind the thermal heads 13 to 15, respectively. The mark sensors 122 to 125 also detects the leading end of the recording sheet 16. It is possible to provide leading end sensors separately from the mark sensors 122 to 125.

The paper guide members 110*a* to 110*c* are each constituted of a pair of arc-shaped guide plates 140 and 141. One guide plates 140 of the pairs are respectively supported on shafts of the pinch rollers 121*b*, 118*b* and 119*b*, whereas the other guide plates 141 of the pairs are supported on shafts of platen rollers 130, 131 and 132. The guide plates 140 and 141 can swing independently from the pinch rollers and the platen rollers 130 to 132, between guide positions where the paper guide members 110*a*, 110*b* and 110*c* are closed, as is shown by chain-dotted lines in FIG. 14, on one hand, and retracted positions where the paper guide members 110*a*, 110*b* and 110*c* are open, as is shown by solid lines in FIG. 14, on the other hand. Not-shown guide plate switching mechanisms switch over the paper guide members 110*a* to 110*c* between the guide positions and the retracted positions.

Prior to printing, the paper guide members 110*a* to 110*c* are set in the guide positions, so the recording sheet 16 is guided along the guide members 110*a* to 110*c*. When the leading end of the recording sheet 16 is detected by the mark sensor 125, the pinch roller 121*a* is moved down to pinch the recording sheet 16 between the rollers 121*a* and 121*b*. Thereafter when the mark sensor 122 detects the leading end, the recording sheet 16 is pinched between the feed rollers 118*a* and 118*b*, and the paper guide member 110*a* is set in the retracted position. As a result, the recording sheet 16 sags between the feed roller pair 121 and the thermal head 13. Similarly, upon detection of the leading end by the mark sensor 123 or 124, the recording sheet 16 is pinched between the feed rollers of one pair 119*a* and 119*b*, or 120*a* and 120*b*, and then the paper guide member 110*b* or 110*c* is set in the retracted position, respectively. In this way, the slack portions 115 to 117 are formed along the curves of the paper guide members 110*a* to 110*c*. Because of the slack portions 115 to 117, even if there occurs any change in load to the recording sheet 16, the change is absorbed, and thus have no effect on the coloring density and the color registration.

Distal end faces 140*a* and 141*a* of the guide plates 140 and 141 are inclined in opposite directions to each other. The guide plates 140 and 141 overlap with each other in the guide position such that the inclined distal end face 140*a* of the upstream guide plate 140 is laid on the inclined distal end face 141*a* of the downstream guide plate 141, and that guide surfaces 140*b* and 141*b* of the guide plates 140 and 141 continues to each other without any stepped portion. So the leading end of the recording sheet 16 can smoothly guided over the joint between the guide plates 140 and 141. The movable guide plates 140 and 141 may be mounted to specific shafts, instead of the shafts of the capstan rollers 121*b*, 118*b*, 119*b* and the platen rollers 130 to 132. The movable guide plates 140 and 141 should not necessarily be pivotal, but may be retracted from the transport path in a lateral or a vertical direction to the recording sheet 16.

Figure 15:
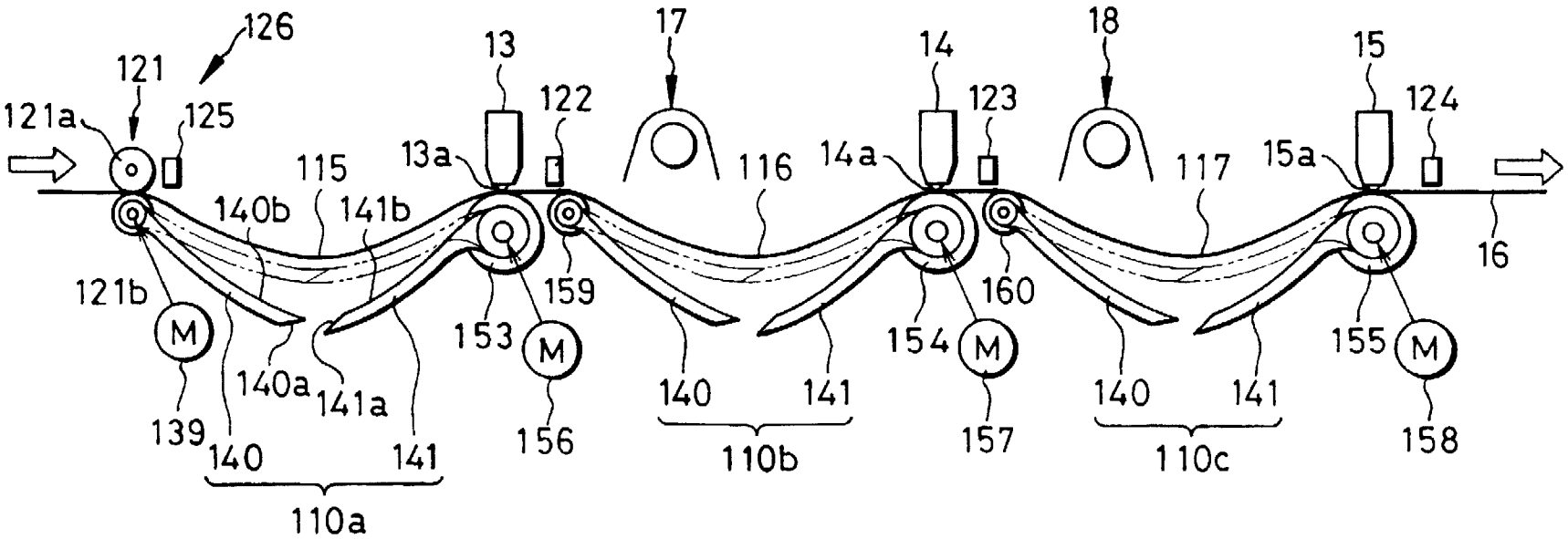
FIG. 15 is an explanatory view illustrating a color thermal printer according to a fourth embodiment of the invention.

FIG. 15 shows a further embodiment similar to the embodiment shown in FIG. 14, wherein a recording sheet 16 is nipped between the heating element arrays 13*a* to 15*a* of the thermal heads 13 to 15 and platen rollers 153, 154 and 155, and the platen rollers 153 to 155 are rotated by pulse motors 156, 157 and 158 to transport the recording sheet 16. According to this embodiment, the feed roller pairs 118 to 120 are not necessary, but some guide rollers 159 and 160 besides the platen rollers 153 to 155 are enough, so that the transporting mechanism is simplified. Also, mark sensors 122 to 124 are disposed immediately behind the platen rollers 153 to 155, respectively.

It may be possible to provide a movable paper pushing member above the transport path before each of three color thermal heads, so as to push the recording sheet in a direction perpendicular to the transport direction after the recording sheet is nipped between a pair of feed rollers which are disposed immediately behind each of the color thermal heads.

Figure 16:
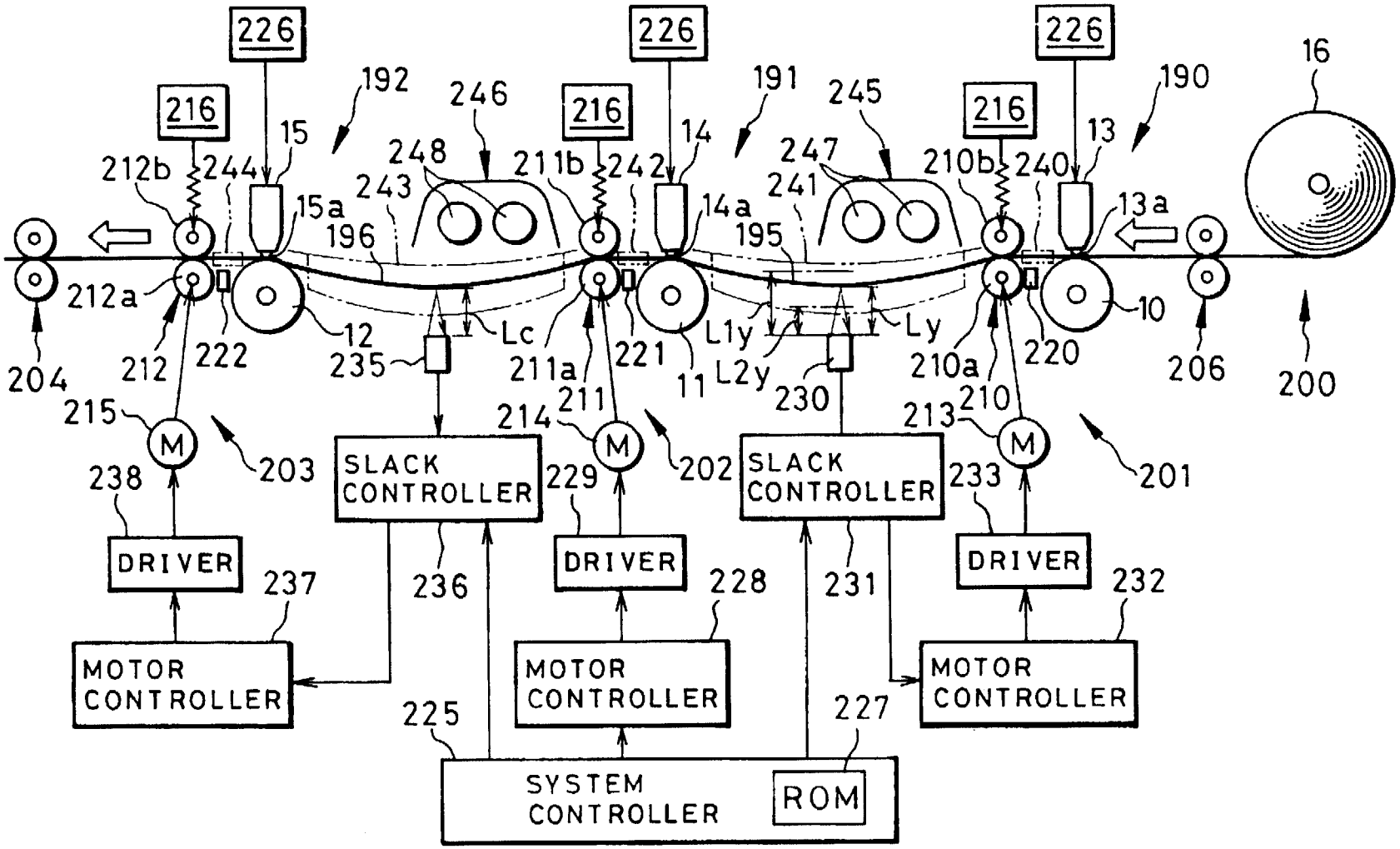
FIG. 16 is an explanatory view illustrating a color thermal printer according to a fifth embodiment of the invention.
Figure 17:
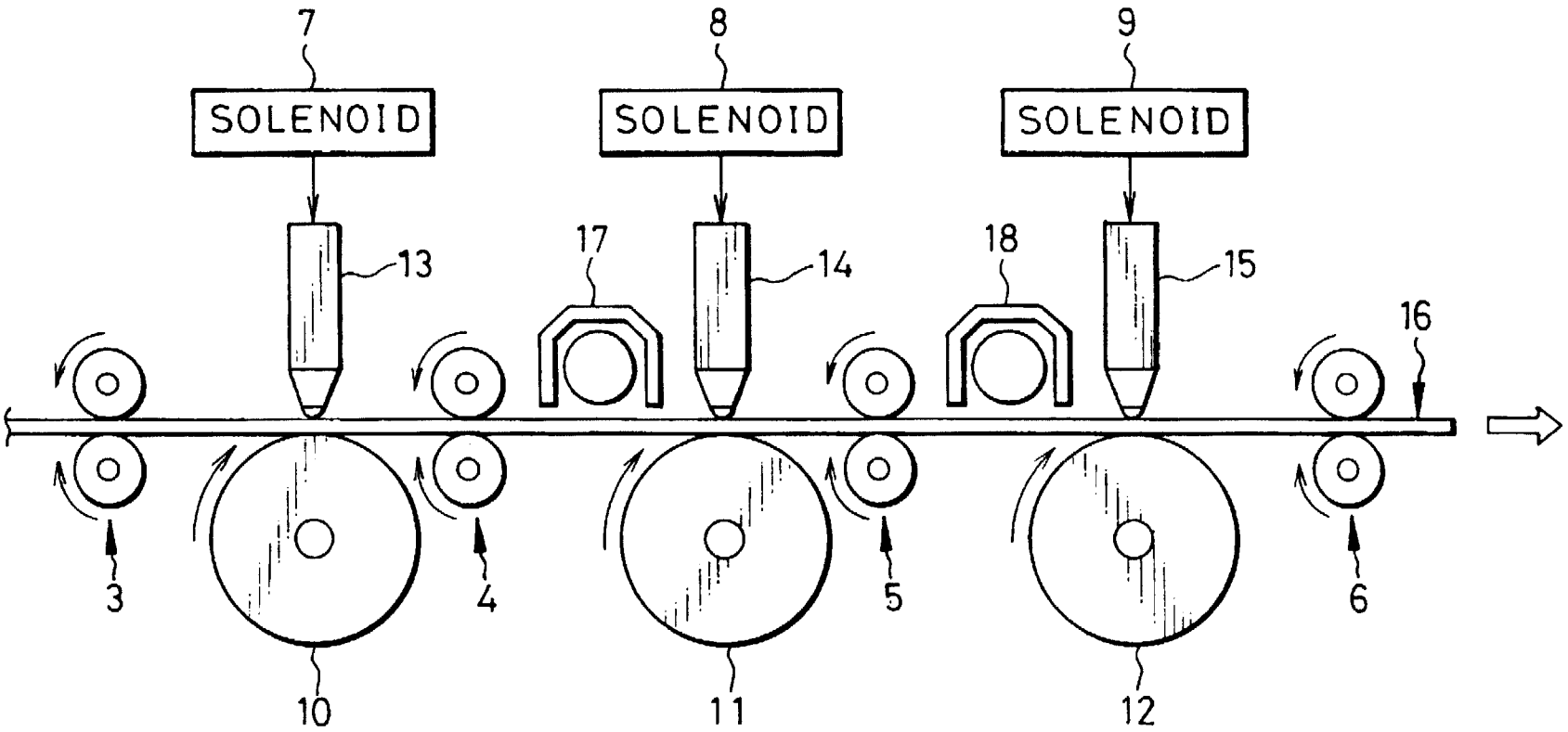
FIG. 17 (PRIOR ART)
FIG. 17 is an explanatory view illustrating a known color thermal printer of one-pass three-head type.
Figure 18A:
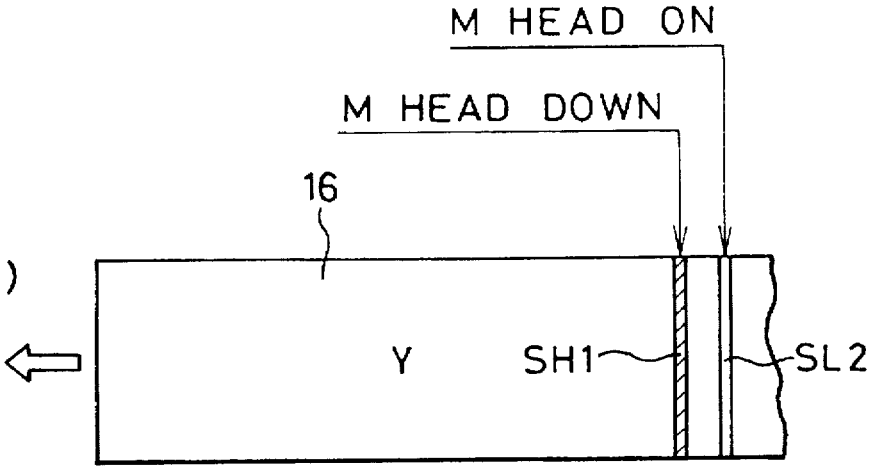
FIG. 18 A (PRIOR ART)
FIGS. 18A and 18B are explanatory views illustrating occurrence of stripes of irregularly high or low optical densities.
Figure 18B:
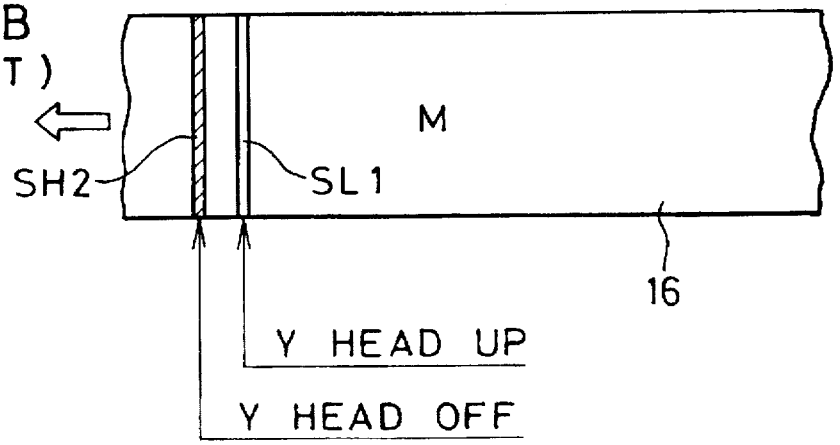
FIG. 18 B (PRIOR ART)

FIG. 16 shows a thermal printer according to another preferred embodiment of the invention, whose construction is fundamentally equivalent to those of the embodiment shown in FIG. 1. The essential feature of this embodiment is that motor drive pulses for a pulse motor 214 in a transporting section 202 of a magenta print station 191 are fixed at a constant pulse rate, whereas pulse rates of motor drive pulses for pulse motors 213 and 215 in transporting sections 201 and 203 of yellow and cyan print stations 190 and 192 are changed to control the respective amounts of slack portions 195 and 196. That is, the slack portions 195 and 196 are formed by loosening the recording sheet 16 to sag between the print stations 190 to 192.

As a measure of the amount of the slack 195, a distance Ly from a lowest surface or the bottom of the slack portion 195 to a slack sensor 230 is detected by the slack sensor 230. The slack sensor 230 is a micro-displacement gage or a reflective photosensor, and is disposed under the slack 195 in a middle of the transport path between the yellow and magenta print stations 190 and 191. In the same way, a distance Lc from a lowest surface of the slack 196 to a slack sensor 235 is detected by the slack sensor 235 as a measure of the amount of the slack 196.

A paper feed mechanism 200 has a pair of feed-in rollers 206 which are rotated by a not-shown motor to feed a recording sheet 16 to the yellow transport section 201. A paper ejection mechanism includes a pair of feed-out rollers 204 which are rotated by a not-shown motor to feed out the recording sheet 16 after printing. Thereafter, the recording sheet 16 is cut into pieces of individual images.

The transport sections 201 to 203 have a pair of feed rollers 210, 211 and 212 each. Each pair of the feed rollers 210, 211 and 212, consists of a capstan roller 210*a*, 211*a* or 212*a* and a pinch roller 210*b*, 211*b* or 212*b*. The capstan rollers 210*a*, 211*a* and 212*a* are respectively and independently driven by the pulse motors 213 to 215. The pinch rollers 210*b*, 211*b* and 212*b* are movable up and down between a pinch position and a release position through a roller shift mechanism 216.

Reflective photosensors 220, 221 and 222 are provided as marks sensors between the capstan rollers 210*a* to 212*a*, on one hand, and respective platen rollers 10, 11 and 12, on the other hand, to detect positioning marks formed on the recording sheet 16 at regular intervals, and also detect the leading end of the recording sheet 16. Detection signals from the mark sensors 220 to 222 are sent to a system controller 225. The system controller 225 discriminates the detection signals between those representative of the leading end and those representative of the positioning marks, depending on the magnitude of signal level change.

The system controller 225 causes the thermal heads 13 to 15 to move into respective retracted positions through a head shift mechanism 226, and also sets the feed rollers 210 to 212 and the feed-out rollers 207 in the release position, while the leading end of the recording sheet 16 passes those members. A predetermined time after the start of paper feeding, which is previously stored in a ROM 227 of the system controller 225 and represents the time necessary for the leading end of the recording sheet 16 to pass the thermal head 13, the system controller 225 causes the thermal head 13 to move down to press its heating element array 13*a* onto the recording sheet 16. It is possible to determine the pass of the leading end of the recording sheet 16 on the basis of counting motor drive pulses supplied to a not-shown pulse motor for rotating the feed-in rollers 206. In the same way as for the thermal head 13, the feed roller pair 210 is set in the pinching position when the leading end of the recording sheet 16 has passed therethrough.

In the magenta print station 191, the thermal head 14 is moved down in a predetermined time after the leading end detection signal is outputted from the mark sensor 220 of the yellow print station 190. So is the feed roller pair 211 set in the pinching position. Similarly, in the cyan print station 192, the leading end of the recording sheet 16 is determined based on time after the leading end detection by the mark sensor 221 of the magenta print station 191. Also, the feed-out rollers 204 is set in the pinching position when a predetermined time passes away from the output of the leading end detection signal of the mark sensor 222.

It is possible to move down the thermal head and the pinch roller with reference to the leading end detection signal from the mark sensor of the same print station.

The thermal heads 13 to 15 start recording the first line of each frame when a leading margin of a print area is determined to be placed under the heating element array 13*a*, 14*a* or 15*a* based on the positioning mark detection signal from the mark sensor 220, 221 or 222 of the same print station.

The pulse motor 213 of the yellow print station 190 is controlled by a motor controller 232 through a driver 233. The pulse motor 214 of the magenta print station 191 is controlled by a motor controller 228 through a driver 229. The pulse motor 215 of the cyan print station 192 is controlled by a motor controller 237 through a driver 238. The quantities or amounts of the slack portions 195 and 196 are controlled to be in a predetermined range in the following manner. First, all of the pulse motors 213 to 215 are driven with motor drive pulses of a standard pulse rate. Next, pulse rate of the motor drive pulses to the pulse motor 213 of the yellow print station 190 is set higher than the standard value, whereas pulse rate of the motor drive pulses to the pulse motor 215 of the cyan print station 192 is set lower than the standard value. Thus, the slack portions 195 and 196 are formed.

Simultaneously, the distances Ly and Lc are measured by the slack sensors 230 and 235. If the distance Ly is more than a predetermined maximum value L1y, the pulse rate of the motor drive pulses to the pulse motor 213 is made higher than the present value. Then, the speed of transportation in the yellow transport section 201 is raised to reduce the distance Ly. An decrease in the distance Ly means an increase in the amount of the slack 195. On the contrary, when the distance Ly is less than a predetermined minimum value L2y, the pulse rate of the motor drive pulses to the pulse motor 213 is made lower than the present value. Then, the speed of transportation in the yellow transport section 201 is lowered to increase the distance Ly, and thus reduce the amount of the slack 195.

In the same way as for the slack 195, the amount of the slack 196 is controlled based on the distance Lc detected by the slack sensor 235. Paper guide members 240 to 244 are disposed along the transport path, as is shown by chain-dotted lines. Optical fixing devices 245 and 246 for yellow and magenta have each a pair of ultraviolet lamps 247 and 248 which extend in parallel to each other and perpendicularly to the transporting direction. The optical fixing device 245 or 246 may have an ultraviolet lamp of U-shape in place of the pair of ultraviolet lamps 247 or 248.

It may be possible to form the guide member as a single-piece member and retract the same vertically, horizontally or diagonally from the transport path.

It is possible to fix pulse rate of the motor drive pulses to the motor 213 at the standard value, and change pulse rate of the motor drive pulses to the motors 214 and 215 to control the slack amount. It may be possible to fix pulse rate of the motor drive pulses to all of the motors 213 and 215 at the standard value, but change pulse rate of the motor drive pulses to the motor 214 so as to control the slack amount after the amounts of the slack portions 195 and 196 are once set in the predetermined range.

As described so far, according to the present invention, if there is any change in load to the recording sheet 16, the slack portions absorb the fluctuation in transporting speed caused by the load change, so that the load change have no influence on the coloring density and the color registration.

Although the present invention has been described in detail with respect to some preferred embodiments, the present invention should not be limited to those embodiments.

For example, it is possible to move the thermal heads 13 to 15 simultaneously down to the actuating position after the leading end of the recording sheet 16 has passed the last thermal head 15, to reduce the frequency of load change. But it is of course possible to move the thermal heads 13 to 15 up and down at the end of each frame recording and at the start of the next frame recording. Even in that case, the load change caused by the up-down movement of the thermal heads 13 to 15 will not adversely affect the recording in the next print station. It is possible to fix the thermal heads and move the platen rollers, so that the positions of the heating element arrays relative to the recording sheet will not fluctuate.

The recording sheet may be transported in a substantially vertical direction, though it is transported horizontally in the above embodiments. It is also possible to transport the recording sheet along a curved path. In the straight transport path as shown in the drawings, the platen rollers may be replaced by platen plates. The recording sheet should not be limited to a long continuous sheet withdrawn from a supply roll, but may be cut in a length extending over a plurality of print stations.

It is possible to use a color thermosensitive recording sheet including a black recording layer in addition to the yellow, magenta and cyan recording layers. In that case, four thermal heads should be disposed along the transport path. The recording sheet may further includes another color recording layer which can develop a specific color. Five thermal heads are necessary for that recording sheet.

The present invention is applicable not only to color direct thermal printers, but also to color thermal wax transfer printers and color thermal ink transfer printers.

Thus, various changes and modifications may be possible to those skilled in the art without departing from the spirit and scope of the appended claims.

What is claimed is:

1. A method of printing a full-color image on a recording sheet by a thermal printer having a plurality of print stations, said print stations being arranged in series along a transport path through which the recording sheet is transported one time, each of said print stations being adapted to record one color frame of the full-color image and comprising a thermal head and a platen disposed across said transport path from each other, said method comprising the steps of:

A. nipping said recording sheet between said thermal head and said platen in each of said print stations;

B. starting, after step A, thermal recording by said thermal head when a designated position of said recording sheet reaches said thermal head in each of said print stations; and C. providing a slack portion in said recording sheet between adjacent two of said print stations.

2. The method according to claim 1, wherein step C comprises the step of:

transporting said recording sheet at a higher speed through an upstream one of said adjacent two print stations than a transporting speed of said recording sheet through a downstream one of said adjacent two print stations.

3. The method according to claim 2, wherein step C further comprises the step of controlling relative transporting speed of said recording sheet through each of said print stations, so as to maintain said slack portion in a predetermined quantity range.

4. The method according to claim 3, wherein each of said print stations comprises a pair of feed rollers which are rotated by a pulse motor, and wherein said step of controlling relative transporting speed comprises the step of changing pulse rate of motor drive pulses supplied to said pulse motor between said print stations.

5. The method according to claim 3, wherein said platen is formed as a platen roller which is rotated by a pulse motor, and wherein said step of controlling relative transporting speed comprises the step of changing pulse rate of motor drive pulses supplied to said pulse motor between said print stations.

6. The method according to claim 3, wherein said step of controlling relative transporting speed is made in those periods when said thermal head is not making thermal printing in each of said print stations.

7. The method according to claim 3, further comprising the step of correcting heat energy radiated from said thermal head in one of said print stations while the transporting speed through said one print station is being changed, so as to cancel fluctuation in recording density which would be caused by the change in the transporting speed.

8. The method according to claim 1, wherein said recording sheet is a color thermosensitive recording medium having at least three thermosensitive color recording layers including a thermosensitive yellow recording layer, a thermosensitive magenta recording layer, and a thermosensitive cyan recording layer, said thermosensitive color recording layers having heat sensitivities decreasing with distance of said thermosensitive color recording layers from an obverse surface of said thermosensitive color recording medium, and wherein said method further comprises the steps of:

exposing said thermosensitive recording medium to electromagnetic rays of a first wavelength range to optically fix the most obverse thermosensitive color recording layer after the most obverse thermosensitive color recording layer is thermally recorded in the first one of said print stations in the order from upstream to downstream of said transport path;

thereafter thermally recording the second obverse thermosensitive color recording layer in the second one of said print stations in the order from upstream to downstream of said transport path; and thereafter exposing the second obverse thermosensitive color recording layer to electromagnetic rays of a second wavelength range to optically fix the second obverse thermosensitive color recording layer.

9. The method according to claim 1, wherein step C comprises the steps of:

extending said transport path in a substantially horizontal direction;

providing a movable guide member between said adjacent two print stations, said guide member having a concavely curved guide surface for said recording sheet to slide thereon; guiding a leading end of said recording sheet along said guide member; and retracting said guide member from said transport path of said recording sheet after said leading end of said recording sheet has passed said guide member.

10. A color thermal printer for printing a full-color image on a recording sheet in a frame sequential fashion, said thermal printer comprising:

transporting means for transporting said recording sheet along a transport path;

a plurality of print stations arranged in series along said transport path, each of said print stations being adapted to record one color frame of the full-color image and comprising a thermal head and a platen disposed across said transport path from each other and movable relative to each other to nip said recording sheet between said thermal head and said platen in each of said print stations;

controlling means for starting thermal recording of one color frame by said thermal head when a designated position of said recording sheet reaches said thermal head in each of said print stations; and slack providing means for providing a slack portion in said recording sheet between adjacent two of said print stations, so that said slack portion absorb a change in load applied to said recording sheet while being transported.

11. The color thermal printer according to claim 10, wherein said slack providing means comprises speed controlling means for controlling said transporting means so as to transport said recording sheet at a higher speed through an upstream one of said adjacent two print stations than a transporting speed of said recording sheet through a downstream one of said adjacent two print stations.

12. The color thermal printer according to claim 11, wherein said slack providing means further comprises means for measuring quantity of said slack portion and outputting a signal representative of the quantity of said slack portion to said speed controlling means, said speed controlling means controlling relative transporting speed of said recording sheet through each of said print stations, so as to maintain said slack portion in a predetermined quantity range.

13. The color thermal printer according to claim 12, wherein said transporting means comprises at least a pair of feed rollers rotated by a pulse motor in each of said print stations, and said speed controlling means control relative transporting speed by changing pulse rate of motor drive pulses supplied to said pulse motor between said print stations.

14. The color thermal printer according to claim 12, wherein said platen is formed as a platen roller which is rotated by a pulse motor, said platen roller and said pulse motor constituting said transporting means of each of said print stations, and wherein said speed controlling means control relative transporting speed by changing pulse rate of motor drive pulses supplied to said pulse motor between said print stations.

15. The color thermal printer according to claim 12, further comprising means for correcting heat energy from said thermal head in one of said print stations while the transporting speed through said one print station is being changed, so as to cancel fluctuation in recording density which would be caused by the change in the transporting speed.

16. The color thermal printer according to claim 10, wherein said recording sheet is a color thermosensitive recording medium having at least three thermosensitive color recording layers including a thermosensitive yellow recording layer, a thermosensitive magenta recording layer, and a thermosensitive cyan recording layer, said thermosensitive color recording layers having heat sensitivities decreasing with distance of said thermosensitive color recording layers from an obverse surface of said thermosensitive color recording medium, and said color thermal printer further comprises:

a first optical fixing device disposed behind the first one of said print stations in the order from upstream to downstream of said transport path, said first optical fixing device radiating electromagnetic rays of a first wavelength range to optically fix the most obverse thermosensitive color recording layer after thermal recording to the most obverse thermosensitive color recording layer is made in the first print station; and a second optical fixing device disposed behind the second one of said print stations in the order from upstream to downstream of said transport path, said second optical fixing device radiating electromagnetic rays of a second wavelength range to optically fix the second obverse thermosensitive color recording layer after thermal recording to the second obverse thermosensitive color recording layer is made in the second print station.

17. The color thermal printer according to claim 10, wherein said transport path extends in a substantially horizontal direction, and said slack providing means comprises:

a movable guide member disposed between said adjacent two print stations, said guide member having a concavely curved guide surface for allowing a leading end of said recording sheet to slide thereon;

a sensor disposed on a side of said transport path for detecting a leading end of said recording sheet; and a mechanism for retracting said guide member from said transport path of said recording sheet after said sensor detects that said leading end of said recording sheet has passed said guide member.

18. The color thermal printer according to claim 17, wherein said guide member is constituted of a pair of arc-shaped guide plates, said guide plates being movable between a guide position where said guide plates connect to each other to form said concavely curved guide surface, on one hand, and a retracted position where said guide plates separate from each other and from said recording sheet.

* * * * *